US007398562B2

(12) United States Patent
Mollo

(10) Patent No.: US 7,398,562 B2
(45) Date of Patent: Jul. 15, 2008

(54) ARTICLE WITH 3-DIMENSIONAL SECONDARY ELEMENT

(75) Inventor: Richard Mollo, Bridgewater, NJ (US)

(73) Assignee: Easy Rhino Designs, Inc., Bound Brook, NJ (US)

( * ) Notice: Subject to any disclaimer, the term of this patent is extended or adjusted under 35 U.S.C. 154(b) by 353 days.

(21) Appl. No.: 10/797,347

(22) Filed: Mar. 10, 2004

(65) Prior Publication Data

US 2005/0198725 A1 Sep. 15, 2005

(51) Int. Cl.
*A42B 1/24* (2006.01)

(52) U.S. Cl. ..... 2/425; 2/209.13

(58) Field of Classification Search ..... 2/424, 2/422, 410, 425, 209.13, 171, 411; 446/27; 40/329, 586; D29/102, 103, 106; D2/891, D2/895, 866, 870, 878
See application file for complete search history.

(56) References Cited

U.S. PATENT DOCUMENTS

| | | | | |
|---|---|---|---|---|
| D5,560 | S | 2/1872 | Watters | |
| D11,176 | S * | 5/1879 | Cairns | D29/104 |
| 470,131 | A | 3/1892 | Hoppe | |
| 488,188 | A | 12/1892 | Drake | |
| 515,133 | A | 2/1894 | Simpson | |
| 521,213 | A | 6/1894 | Hayes | |
| 524,528 | A | 8/1894 | Hobson | |
| 551,818 | A | 12/1895 | Good | |
| 557,864 | A | 4/1896 | McNamara et al. | |
| 575,221 | A | 1/1897 | Eisenbeis et al. | |
| 674,321 | A | 5/1901 | Stow | |
| 688,483 | A | 12/1901 | Pell | |
| 736,685 | A | 8/1903 | Camins | |
| 1,007,984 | A | 11/1911 | Skelding | |
| D45,522 | S | 3/1914 | Collins | |
| 1,169,188 | A | 1/1916 | Peck | |
| 1,286,476 | A | 12/1918 | Woloszczuk | |
| 1,290,162 | A | 1/1919 | Frieband | |
| 1,409,808 | A | 3/1922 | Wood | |
| 1,456,524 | A | 5/1923 | Waldron | |
| 1,483,626 | A | 2/1924 | Gayeski | |
| 1,502,108 | A | 7/1924 | McWilliam | |
| 1,545,034 | A | 7/1925 | Burns | |
| 1,586,701 | A | 6/1926 | Reppa | |
| 1,616,187 | A | 2/1927 | Hart | |
| 1,776,249 | A | 9/1930 | Bullard | |
| 1,810,549 | A | 6/1931 | Allen | |
| 2,014,324 | A | 9/1935 | Goldstein et al. | |
| 2,088,183 | A | 7/1937 | Watkins | |
| 2,131,617 | A | 9/1938 | Cowden | |

(Continued)

FOREIGN PATENT DOCUMENTS

DE 4421110 A1 * 12/1995

*Primary Examiner*—Danny Worrell
(74) *Attorney, Agent, or Firm*—Lerner, David, Littenberg, Krumholz & Mentlik, LLP

(57) ABSTRACT

An article having a generally domed-shaped crown and an exterior surface. A secondary element extending from the exterior surface at an intersection area between the crown and the secondary element. A portion of the exterior surface of the crown typically being raised above the intersection area to give the appearance that the secondary element has torn, morphed, splashed, cracked or phase changed, such as by melting, through the crown. The secondary element is typically indicative of a particular sporting club and the article is typically a helmet. The secondary element is also typically integrally molded with the crown.

34 Claims, 14 Drawing Sheets

U.S. PATENT DOCUMENTS

| | | | | | |
|---|---|---|---|---|---|
| 2,329,457 | A | | 9/1943 | Ceriello | |
| 2,340,872 | A | | 2/1944 | Flynn et al. | |
| 2,428,746 | A | | 10/1947 | Veneklasen | |
| 2,478,936 | A | | 8/1949 | Motsinger | |
| 2,501,006 | A | * | 3/1950 | Rothchild | 362/106 |
| D167,789 | S | * | 9/1952 | Adams | D29/106 |
| D167,790 | S | * | 9/1952 | Adams | D29/106 |
| D167,791 | S | * | 9/1952 | Adams | D29/106 |
| D171,492 | S | | 2/1954 | Erickson et al. | |
| 2,688,204 | A | | 9/1954 | Laubhan | |
| 2,739,311 | A | | 3/1956 | Bullard | |
| D179,967 | S | * | 4/1957 | Erickson | D29/104 |
| D180,052 | S | * | 4/1957 | Young | D2/869 |
| 2,805,419 | A | | 9/1957 | Finken | |
| 2,809,374 | A | | 10/1957 | Reed | |
| 2,818,511 | A | | 12/1957 | Ullery, Jr. et al. | |
| 2,867,812 | A | | 1/1959 | Roth et al. | |
| 2,871,484 | A | | 2/1959 | Finken et al. | |
| 2,872,840 | A | | 2/1959 | Stanton | |
| 2,895,137 | A | | 7/1959 | Simpson et al. | |
| 2,904,645 | A | | 9/1959 | Sarles | |
| 3,030,627 | A | | 4/1962 | Rehman et al. | |
| 3,078,845 | A | | 2/1963 | Kohlmeyer | |
| 3,088,002 | A | | 4/1963 | Heisig | |
| 3,103,015 | A | | 9/1963 | Plastino | |
| 3,106,184 | A | * | 10/1963 | Shea | 116/209 |
| 3,108,282 | A | | 10/1963 | Rehman et al. | |
| 3,128,095 | A | | 4/1964 | Sharkey | |
| 3,146,462 | A | | 9/1964 | Militello | |
| 3,148,376 | A | | 9/1964 | Aileo | |
| 3,155,981 | A | | 11/1964 | McKissick et al. | |
| 3,172,126 | A | | 3/1965 | Spano et al. | |
| 3,174,155 | A | | 3/1965 | Pitman | |
| 3,183,443 | A | | 5/1965 | Lefevre | |
| 3,203,003 | A | | 8/1965 | Plastino | |
| 3,205,508 | A | | 9/1965 | Cox | |
| 3,223,086 | A | | 12/1965 | Denton | |
| 3,229,872 | A | | 1/1966 | Williams | |
| 3,239,842 | A | | 3/1966 | Marchello | |
| 3,242,500 | A | | 3/1966 | Derr | |
| 3,245,087 | A | | 4/1966 | Marchello | |
| 3,249,873 | A | | 5/1966 | Whittemore, Jr. et al. | |
| 3,258,534 | A | | 6/1966 | Goldsworthy | |
| 3,273,162 | A | | 9/1966 | Andrews, III | |
| 3,273,163 | A | | 9/1966 | Andrews, III | |
| 3,283,349 | A | * | 11/1966 | White | 441/124 |
| 3,295,511 | A | | 1/1967 | Crouzet | |
| 3,345,642 | A | | 10/1967 | Uminski | |
| 3,353,534 | A | | 11/1967 | Savoie, Jr. | |
| 3,359,568 | A | | 12/1967 | Kothe | |
| 3,381,308 | A | * | 5/1968 | Fineberg | 2/182.6 |
| 3,435,460 | A | | 4/1969 | Grant | |
| 3,436,760 | A | | 4/1969 | Molitoris | |
| 3,436,936 | A | | 4/1969 | Locker | |
| 3,437,631 | A | | 4/1969 | Cleveland | |
| 3,440,660 | A | | 4/1969 | Krinke | |
| 3,444,288 | A | | 5/1969 | Mead | |
| 3,445,860 | A | | 5/1969 | Rodell | |
| 3,467,964 | A | | 9/1969 | Hannan | |
| 3,473,165 | A | | 10/1969 | Gran et al. | |
| 3,491,371 | A | | 1/1970 | De Angelis | |
| 3,496,854 | A | | 2/1970 | Feldmann et al. | |
| 3,502,074 | A | | 3/1970 | Jones et al. | |
| 3,504,984 | A | | 4/1970 | Bush | |
| 3,505,677 | A | | 4/1970 | Masson et al. | |
| 3,514,785 | A | | 6/1970 | Smith | |
| 3,514,787 | A | | 6/1970 | Kennedy, Jr. | |
| 3,529,451 | A | | 9/1970 | McOsker et al. | |
| 3,531,955 | A | | 10/1970 | Taylor et al. | |
| 3,562,813 | A | | 2/1971 | Origer | |
| 3,568,211 | A | | 3/1971 | Petruzzella, Jr. | |
| 3,577,561 | A | | 5/1971 | Oshima et al. | |
| 3,585,638 | A | | 6/1971 | Aileo | |
| 3,586,977 | A | | 6/1971 | Lustig | |
| 3,594,814 | A | | 7/1971 | Schuessler | |
| 3,596,289 | A | | 8/1971 | Adickes | |
| 3,601,813 | A | | 8/1971 | Aileo | |
| 3,631,540 | A | | 1/1972 | Penny | |
| 3,636,565 | A | | 1/1972 | Luisada et al. | |
| 3,665,514 | A | | 5/1972 | Durand | |
| 3,703,891 | A | | 11/1972 | Talley | |
| 3,721,994 | A | | 3/1973 | DeSimone et al. | |
| 3,726,620 | A | | 4/1973 | Morton | |
| 3,748,657 | A | | 7/1973 | Aileo | |
| 3,750,192 | A | | 8/1973 | Beresic | |
| 3,765,031 | A | | 10/1973 | Beresic | |
| 3,770,483 | A | | 11/1973 | Komine | |
| 3,778,056 | A | | 12/1973 | Witkowski | |
| 3,787,109 | A | | 1/1974 | Vizenor | |
| 3,804,495 | A | | 4/1974 | Rayow et al. | |
| 3,818,508 | A | | 6/1974 | Lammers et al. | |
| 3,825,952 | A | | 7/1974 | Pershing et al. | |
| 3,831,407 | A | | 8/1974 | Coleman | |
| 3,844,840 | A | | 10/1974 | Bender | |
| 3,845,387 | A | | 10/1974 | Humphrey | |
| 3,866,909 | A | | 2/1975 | DeSantis | |
| 3,871,026 | A | | 3/1975 | Dorre | |
| 3,885,246 | A | | 5/1975 | Tung | |
| 3,889,190 | A | | 6/1975 | Palmer | |
| 3,895,625 | A | | 7/1975 | Delest | |
| 3,906,547 | A | | 9/1975 | Aileo | |
| 3,916,312 | A | | 10/1975 | Campbell | |
| 3,917,153 | A | | 11/1975 | Holschneider | |
| 3,922,722 | A | | 12/1975 | Pokhodnya et al. | |
| 3,929,143 | A | | 12/1975 | Coleman | |
| D240,310 | S | | 6/1976 | Sinclair | |
| 3,972,075 | A | | 8/1976 | Alevras | |
| 3,978,526 | A | | 9/1976 | Mitchell et al. | |
| D241,888 | S | | 10/1976 | Lipper | |
| 3,987,495 | A | | 10/1976 | Holley | |
| 3,990,112 | A | | 11/1976 | Ciffolillo | |
| 3,991,422 | A | | 11/1976 | Saotome | |
| 4,017,906 | A | | 4/1977 | Bochynsky et al. | |
| 4,058,854 | A | | 11/1977 | Rhee | |
| 4,062,067 | A | | 12/1977 | Franzen | |
| 4,075,717 | A | | 2/1978 | Lemelson | |
| 4,099,271 | A | | 7/1978 | Allen et al. | |
| 4,100,625 | A | | 7/1978 | Tung | |
| 4,101,983 | A | | 7/1978 | Dera et al. | |
| RE29,742 | E | | 8/1978 | Tung | |
| 4,104,741 | A | | 8/1978 | Shaw et al. | |
| 4,106,124 | A | | 8/1978 | Green | |
| 4,109,105 | A | | 8/1978 | Von Statten, Jr. | |
| 4,109,323 | A | | 8/1978 | Matthias | |
| 4,156,292 | A | | 5/1979 | Helm et al. | |
| 4,156,942 | A | | 6/1979 | Isfeld | |
| 4,179,753 | A | | 12/1979 | Aronberg et al. | |
| 4,203,457 | A | | 5/1980 | Friedman et al. | |
| 4,215,436 | A | | 8/1980 | Ketterer | |
| 4,224,694 | A | | 9/1980 | Palmaer | |
| 4,231,117 | A | | 11/1980 | Aileo | |
| 4,259,747 | A | | 4/1981 | Taesler et al. | |
| 4,269,476 | A | | 5/1981 | Gauthier et al. | |
| 4,270,279 | A | | 6/1981 | Roediger | |
| 4,276,657 | A | | 7/1981 | Montesi | |
| D260,791 | S | | 9/1981 | Suda | |
| 4,288,268 | A | | 9/1981 | Hartung | |
| 4,299,836 | A | | 11/1981 | Mago nee Karacsony et al. | |
| 4,316,289 | A | | 2/1982 | Hild | |
| 4,319,362 | A | | 3/1982 | Ettinger | |
| 4,321,433 | A | | 3/1982 | King | |
| 4,343,047 | A | | 8/1982 | Lazowski et al. | |
| D266,710 | S | | 11/1982 | Richardson | |
| 4,357,711 | A | | 11/1982 | Drefko et al. | |

4,370,758 A 2/1983 Mattheis
4,404,690 A 9/1983 Farquharson
4,424,880 A 1/1984 Murayama et al.
4,428,081 A 1/1984 Smith
4,439,871 A 4/1984 Plastino
4,443,891 A 4/1984 Blomgren et al.
4,451,933 A 6/1984 Seng et al.
4,457,461 A 7/1984 Docking et al.
4,466,138 A 8/1984 Gessalin
4,471,174 A 9/1984 Nava
4,472,472 A 9/1984 Schultz
D277,331 S 1/1985 Clement
4,495,663 A 1/1985 Shieh
4,519,099 A 5/1985 Kamiya et al.
4,521,831 A 6/1985 Thayer
4,530,112 A 7/1985 Cecala et al.
4,542,538 A 9/1985 Moretti et al.
4,556,121 A 12/1985 Palmaer et al.
4,575,875 A 3/1986 Dawson et al.
4,577,347 A 3/1986 Connon
4,581,776 A 4/1986 Kie
4,586,197 A 5/1986 Hubbard
4,586,200 A 5/1986 Poon
4,586,280 A 5/1986 Dane
D284,328 S * 6/1986 Bieber ..... D2/872
4,594,737 A 6/1986 Butash
D284,612 S 7/1986 Gorman
4,598,430 A 7/1986 Nava
4,599,752 A 7/1986 Mitchell
4,601,070 A * 7/1986 Sargentini ..... 2/195.8
4,639,950 A 2/1987 Palmaer
4,641,382 A 2/1987 Gessalin
4,651,357 A 3/1987 Gershoni
4,656,674 A 4/1987 Medwell
4,658,523 A 4/1987 Adell
4,660,230 A 4/1987 Mayling
4,665,569 A 5/1987 Santini
4,667,348 A 5/1987 Sundahl
4,670,912 A 6/1987 Hart
4,689,834 A 9/1987 McCarthy et al.
4,697,289 A 10/1987 Luigi
4,697,783 A 10/1987 Kastendieck et al.
4,703,879 A 11/1987 Kastendieck et al.
4,704,746 A 11/1987 Nava
4,721,517 A 1/1988 Cloutier
4,722,101 A 2/1988 Blower
4,729,132 A 3/1988 Fierro
4,734,939 A 4/1988 Copp
4,734,940 A 4/1988 Galet et al.
4,739,905 A 4/1988 Nelson
D295,800 S 5/1988 Shelton, Jr.
4,741,054 A 5/1988 Mattes
4,744,106 A 5/1988 Wang
4,744,107 A 5/1988 Fohl
4,764,989 A 8/1988 Bourgeois
4,766,610 A 8/1988 Mattes
4,766,616 A 8/1988 Donahue
D298,367 S 11/1988 Ball
4,788,724 A 12/1988 Lazzeroni et al.
4,793,007 A 12/1988 Barnett
4,802,243 A 2/1989 Griffiths
4,803,980 A 2/1989 Nowakowski et al.
4,809,690 A 3/1989 Bouyssi et al.
4,813,083 A 3/1989 Davidson
4,817,633 A 4/1989 McStravick et al.
4,845,786 A 7/1989 Chiarella
4,852,562 A 8/1989 Howie
4,869,245 A 9/1989 Nowakowski et al.
4,897,715 A 1/1990 Beamon, III
4,901,210 A 2/1990 Hanabusa
4,901,813 A 2/1990 Kimura et al.
4,907,296 A 3/1990 Biecha
4,907,582 A 3/1990 Meyerrose
4,926,854 A 5/1990 Bode
D309,509 S 7/1990 Mast
4,937,888 A 7/1990 Straus
4,953,766 A 9/1990 Cruickshank
4,958,264 A 9/1990 Evendon
D311,266 S 10/1990 Parker
D312,915 S 12/1990 Gilfert et al.
4,982,451 A 1/1991 Graham
4,987,608 A 1/1991 Cobb
4,991,235 A 2/1991 Warner
4,993,082 A 2/1991 Gentes et al.
5,001,786 A 3/1991 Copeland
5,003,632 A 4/1991 Claude
5,003,973 A 4/1991 Ford et al.
5,012,528 A 5/1991 Pernicka et al.
5,012,533 A 5/1991 Raffler
5,014,366 A 5/1991 Discipio, Sr.
5,022,100 A 6/1991 Belanger
5,034,747 A 7/1991 Donahue
5,038,047 A 8/1991 Still
D320,476 S * 10/1991 Mele ..... D29/103
5,052,054 A 10/1991 Birum
5,056,156 A 10/1991 Kosmo et al.
5,062,163 A 11/1991 Avey
5,088,127 A * 2/1992 Thornock ..... 2/209.13
5,088,129 A 2/1992 Kamata
H1023 H 3/1992 Wiseman, Sr.
5,093,937 A 3/1992 Kamata
5,093,939 A 3/1992 Noyerie et al.
5,095,550 A 3/1992 Perlinger
5,097,538 A 3/1992 Feuling
5,117,506 A 6/1992 Byrnes et al.
5,124,848 A 6/1992 Capilupi, Jr.
5,136,726 A 8/1992 Kellin et al.
5,138,666 A 8/1992 Bauer et al.
5,142,700 A 8/1992 Reed
5,142,706 A 9/1992 Layhon
5,148,950 A 9/1992 Hosaka
5,157,794 A 10/1992 Kamata
D330,950 S 11/1992 Voepel
5,163,185 A 11/1992 Hodnett
5,165,116 A 11/1992 Simpson
5,173,970 A 12/1992 Shifrin
5,176,342 A 1/1993 Schmidt et al.
5,179,735 A 1/1993 Thomanek
5,193,226 A 3/1993 Mortenson
5,216,758 A 6/1993 Rabquer
5,226,181 A 7/1993 Polednak et al.
D338,514 S 8/1993 Holmes
5,271,102 A 12/1993 Feuling
5,272,773 A 12/1993 Kamata
RE34,525 E 2/1994 Lazzaroni et al.
5,287,560 A 2/1994 Garcia
5,289,591 A 3/1994 Andersen
5,291,880 A 3/1994 Almovist et al.
5,308,671 A 5/1994 Wells
5,309,576 A 5/1994 Broersma
5,323,493 A 6/1994 Ogiba
5,327,587 A 7/1994 Hurwitz
5,327,588 A 7/1994 Garneau
5,329,592 A 7/1994 Altman
5,329,641 A 7/1994 Kalhous
5,331,684 A 7/1994 Baril et al.
5,333,328 A 8/1994 Roberts
5,337,420 A 8/1994 Haysom et al.
5,339,464 A 8/1994 Dor
5,341,512 A 8/1994 Noble
D350,710 S 9/1994 Keiffer
5,353,008 A 10/1994 Eikenberry et al.
5,353,071 A 10/1994 Bradshaw
5,359,734 A 11/1994 Rathburn
5,365,615 A 11/1994 Piszkin
5,373,583 A 12/1994 Birum 5,388,277 A 2/1995 Tanuichi
5,388,278 A 2/1995 Tanuichi
5,394,566 A 3/1995 Hong
5,399,602 A 3/1995 Matsushita et al.
5,409,287 A 4/1995 Suzuki
5,411,695 A 5/1995 Yamada et al.
5,412,810 A 5/1995 Taniuchi
5,416,922 A 5/1995 Horvat et al.
5,421,035 A 6/1995 Klose et al.
5,421,799 A 6/1995 Rabin et al.
5,425,620 A 6/1995 Stroud
5,426,792 A 6/1995 Murasko
5,428,097 A 6/1995 Kobayashi
5,428,845 A 7/1995 Deagan
5,432,960 A 7/1995 Kraut
5,438,702 A 8/1995 Jackson
5,444,870 A 8/1995 Pinsen
5,448,780 A 9/1995 Gath
5,450,631 A 9/1995 Egger
D363,571 S 10/1995 Klose et al.
D364,264 S 11/1995 Sheer
5,465,421 A 11/1995 McCormick et al.
5,467,479 A 11/1995 Mattes
5,469,584 A 11/1995 Casartelli
5,471,678 A 12/1995 Dor
5,477,564 A 12/1995 Tichy
5,477,566 A 12/1995 Massman
5,479,325 A 12/1995 Chien
5,481,762 A 1/1996 Gentes et al.
5,483,956 A 1/1996 Shapiro
5,488,948 A 2/1996 Dubruille et al.
5,493,736 A 2/1996 Allison
5,506,730 A 4/1996 Morley et al.
5,508,334 A 4/1996 Chen
5,508,900 A * 4/1996 Norman ..... 362/106
5,509,144 A 4/1996 Soergel et al.
5,516,832 A 5/1996 Kennan et al.
5,519,892 A 5/1996 Pizzacar
5,519,895 A 5/1996 Barnes, Jr.
5,525,290 A 6/1996 Carpenter
D371,638 S 7/1996 Hoshizaki et al.
5,530,970 A 7/1996 Knutson
5,539,934 A 7/1996 Ponder
5,539,935 A 7/1996 Rush, III
5,544,027 A 8/1996 Orsano
5,544,367 A 8/1996 March, II
5,546,609 A 8/1996 Rush, III
5,546,610 A 8/1996 Herzig et al.
5,553,328 A 9/1996 Hall et al.
5,555,570 A 9/1996 Bay, Jr.
5,561,862 A 10/1996 Flores, Sr.
5,564,128 A 10/1996 Richardson
5,564,129 A 10/1996 Ball et al.
5,566,398 A 10/1996 Deagan
5,572,749 A 11/1996 Ogden
5,581,806 A 12/1996 Capdepuy et al.
5,581,816 A 12/1996 Davis
5,581,818 A 12/1996 Lorenzi et al.
5,581,821 A 12/1996 Nakano
D378,624 S 3/1997 Chartrand
5,608,918 A 3/1997 Salvaggio
5,608,919 A 3/1997 Case
5,609,802 A 3/1997 Jeng
5,619,755 A 4/1997 Casartelli
5,621,922 A 4/1997 Rush, III
5,621,923 A 4/1997 Tapocik
5,628,071 A 5/1997 Nezer
5,636,383 A 6/1997 Cwiakala
5,638,544 A 6/1997 Sump
5,642,221 A 6/1997 Fischer et al.
5,651,145 A 7/1997 Egger
D382,370 S 8/1997 Comstock et al.
5,657,492 A 8/1997 Esposito, Jr.
5,658,065 A 8/1997 Jamieson
5,661,854 A 9/1997 March, II
5,669,079 A 9/1997 Morgan
D385,063 S 10/1997 Anderson
5,675,843 A 10/1997 Grim et al.
5,675,844 A 10/1997 Guyton et al.
5,680,656 A 10/1997 Gath
5,682,615 A 11/1997 Wahl et al.
5,687,426 A 11/1997 Sperber
D387,502 S 12/1997 Comstock et al.
5,697,099 A 12/1997 Siska, Jr. et al.
5,701,609 A 12/1997 Bridges
5,713,082 A 2/1998 Bassette et al.
D392,071 S 3/1998 Berke
5,724,681 A 3/1998 Sykes
5,729,830 A 3/1998 Luhtala
5,729,833 A 3/1998 Judge
5,732,414 A 3/1998 Monica
5,740,557 A 4/1998 Reid et al.
5,745,924 A 5/1998 Egger
5,749,096 A 5/1998 Fergason et al.
5,752,276 A 5/1998 Baudou et al.
5,758,639 A 6/1998 Ikonen
5,768,714 A 6/1998 Bowhey
5,771,493 A 6/1998 Proctor
5,771,497 A 6/1998 Steele
5,774,901 A 7/1998 Minami
5,781,934 A 7/1998 Pauley, Jr.
5,784,724 A 7/1998 Liang
5,794,270 A 8/1998 Howat
5,794,271 A 8/1998 Hastings
5,803,266 A 9/1998 Blackwelder
5,813,055 A 9/1998 Egger
5,813,990 A 9/1998 Ryll
5,815,841 A 10/1998 Spangrud
D401,018 S 11/1998 Chartrand
5,832,541 A 11/1998 Rock
5,833,796 A 11/1998 Matich
5,857,599 A 1/1999 Palmer
5,860,167 A 1/1999 Lizio
5,873,132 A 2/1999 Grilliot et al.
D406,399 S 3/1999 Hohdorf
5,896,587 A 4/1999 Gentry
5,901,369 A 5/1999 Pilney
5,903,925 A 5/1999 Engebretson
5,903,926 A 5/1999 Fleming
D410,571 S 6/1999 Lu
5,915,537 A 6/1999 Dallas et al.
5,915,539 A 6/1999 Lack
5,926,848 A 7/1999 Bartholomae
5,926,854 A 7/1999 Grilliot et al.
D413,185 S 8/1999 Egger
5,940,880 A 8/1999 Phillips
5,943,706 A 8/1999 Miyajima et al.
5,946,728 A 9/1999 Tane
5,953,762 A * 9/1999 Corbett ..... 2/425
5,956,777 A 9/1999 Popovich
D415,593 S 10/1999 Tang
D415,860 S 10/1999 Egger
5,978,972 A 11/1999 Stewart et al.
5,978,973 A 11/1999 Chartrand
5,983,400 A 11/1999 Kronenberger
5,993,428 A 11/1999 Hardge
5,996,125 A 12/1999 Garzone
5,996,127 A 12/1999 Leslie
5,996,128 A 12/1999 Yanagihara
6,000,063 A * 12/1999 Sullivan ..... 2/209.13
6,000,066 A 12/1999 Williams
6,009,561 A 1/2000 Bullock et al.
6,009,562 A 1/2000 Bullock et al.
6,009,563 A 1/2000 Swanson et al.
6,016,805 A 1/2000 Burns et al.
D420,670 S 2/2000 Hernandez et al.

6,029,282 A 2/2000 Buschman
6,029,283 A * 2/2000 Comstock et al. ..... 2/422
6,035,450 A 3/2000 Monsen, III et al.
6,038,704 A 3/2000 Crescentini
6,047,412 A 4/2000 Wilson, II et al.
6,048,486 A 4/2000 Fels et al.
6,052,832 A 4/2000 Crompton
6,052,833 A 4/2000 Norman
RE36,691 E 5/2000 Pinsen
6,058,515 A 5/2000 Kitahara
6,070,271 A 6/2000 Williams
D428,535 S 7/2000 Ball et al.
6,081,933 A 7/2000 Partsch, IV
6,091,832 A 7/2000 Shurman et al.
6,098,197 A 8/2000 Hetzel, Jr. et al.
6,101,636 A * 8/2000 Williams ..... 2/410
6,105,172 A 8/2000 Shida
6,105,176 A 8/2000 Egger
6,105,827 A 8/2000 Rowan
6,122,773 A 9/2000 Katz
6,125,477 A 10/2000 Crippa et al.
D433,541 S 11/2000 Ball et al.
6,151,719 A 11/2000 Poole
6,154,889 A 12/2000 Moore, III et al.
6,159,324 A 12/2000 Watters et al.
6,163,891 A 12/2000 Viitalahti
6,167,574 B1 1/2001 Hayashida
6,170,084 B1 1/2001 Gordon et al.
6,175,963 B1 1/2001 Loeffelholz
6,182,298 B1 2/2001 Dampney
6,219,849 B1 4/2001 Crescentini
6,226,803 B1 5/2001 Tanaka
6,237,162 B1 5/2001 Gill
D444,269 S 6/2001 Jeffreys
6,243,876 B1 6/2001 Provenzano et al.
6,243,881 B1 6/2001 Brinkman
6,247,824 B1 6/2001 Berke et al.
D445,218 S 7/2001 Watters et al.
D445,962 S 7/2001 Brignone et al.
6,256,796 B1 7/2001 Fleming
6,256,797 B1 7/2001 Nemoto et al.
6,256,799 B1 7/2001 McGlasson et al.
6,263,513 B1 7/2001 Murakami
6,266,824 B1 7/2001 Giansanti
6,279,172 B1 8/2001 Epperson et al.
D447,604 S 9/2001 Watters et al.
D448,526 S 9/2001 Brignone et al.
6,289,903 B1 9/2001 Haufler
6,292,952 B1 9/2001 Watters et al.
6,292,953 B1 9/2001 Beautz
D448,890 S 10/2001 Brignone et al.
D449,411 S 10/2001 Largeot
D449,901 S 10/2001 Morin
6,295,652 B1 10/2001 Mazur
6,301,718 B1 10/2001 Rigal
6,301,719 B1 10/2001 Goodhand et al.
6,301,720 B1 10/2001 Bataille et al.
6,305,029 B1 10/2001 Reynolds
6,308,343 B1 10/2001 Arai
6,314,586 B1 11/2001 Duguid
6,332,228 B1 12/2001 Takahara
6,339,849 B1 1/2002 Nelson et al.
D453,590 S 2/2002 Ho
D453,860 S 2/2002 Lu
D453,975 S 2/2002 Ho
6,343,385 B1 2/2002 Katz
6,349,416 B1 2/2002 Lampe et al.
D454,987 S 3/2002 Hahm
6,352,383 B1 3/2002 Ristola
6,357,052 B1 3/2002 Fleming
6,360,376 B1 3/2002 Carrington
D455,869 S 4/2002 Ho
D456,567 S 4/2002 Ho
6,363,539 B2 4/2002 Tachi et al.
6,371,710 B1 4/2002 Ide et al.
6,374,419 B1 4/2002 Pietsch
6,374,423 B1 4/2002 Anderson et al.
6,378,390 B2 4/2002 Saito
D457,274 S 5/2002 Taniuchi et al.
D457,691 S 5/2002 Taniuchi et al.
6,381,759 B1 5/2002 Katz
6,389,606 B1 5/2002 Galet et al.
6,389,607 B1 5/2002 Wood
D458,415 S 6/2002 Taniuchi et al.
D459,032 S 6/2002 Gatellet
D459,554 S 6/2002 Gatellet
D459,555 S 6/2002 Gatellet
6,397,399 B1 6/2002 Lampe et al.
6,401,258 B1 6/2002 Wilson
6,401,260 B1 6/2002 Porth
6,401,262 B2 6/2002 Bacchiega
6,401,711 B1 6/2002 Tibbs et al.
6,405,382 B2 6/2002 Shida
D460,219 S 7/2002 Taniuchi et al.
D460,441 S 7/2002 Neil
6,418,929 B1 7/2002 Norfleet
6,421,837 B1 7/2002 Pearcy
6,421,840 B1 7/2002 Chen et al.
6,434,755 B1 8/2002 Halstead et al.
6,505,351 B2 * 1/2003 Yeh ..... 2/206

* cited by examiner

ARTICLE WITH 3-DIMENSIONAL SECONDARY ELEMENT

BACKGROUND OF THE INVENTION

My invention relates broadly to articles, novelties, paraphernalia and the like having three-dimensional secondary elements connected thereto or integrally molded therewith, and configured in a manner so as to be indicative of a sporting team. It is well known that professional and amateur sporting clubs have specific insignias, logos or mascots to distinctly identify each club. In order to show their loyalty to the sporting club, fans of the clubs often wear articles of apparel or display objects adorned with images emblematic of such insignias, logos or mascots. For sporting events requiring use of a helmet, such as football, one of the most popular apparel or display items is a football helmet that may be associated with a specific team. Such helmets are frequently worn or displayed by fans.

The prior art abounds with helmets incorporating a particular team's insignia, emblem or mascot. Often, fans simply wear a helmet identical to those worn by the players on the field. Unlike the present invention, these helmets only have two-dimensional images, rather than three-dimensional sculptures.

Helmets or baseball style hats having a three-dimensional team insignias are known. Such helmets and hats are often adorned with soft, spongy sculptures indicative of a particular team. Heretofore, the sculptures have been attached to the hats or helmets via non-permanent means, such as hook and loop type fasteners, buttons, sewn seams, adhesives, and the like. Generally, the transition between the hat or helmet and the sculptured portion is very distinct. No apparent effort has been made to incorporate a smooth transition from the sculpted image to the hat or helmet.

Helmets with three-dimensional sculptures adorned thereon are also known, such as those used as motorcycle helmets. In use for motorcycle helmets, the sculpted images are generally made from rubbery or other soft or elastic material such as latex and simply adhered to an existing helmet. Helmets of this type specifically utilize rubbery or flexible material, as this material absorbs impacts for increased safety and is less likely to be broken off upon use. Again, no apparent attempt has been made to incorporate a smooth transition from the sculpted image to the helmet. In addition, there has been no apparent attempt to form the helmet and sculpted object in such a manner as to give an impression that the sculpted object is anything but simply adhered to the helmet.

It would therefore be desirable to have a novel article or item of paraphernalia, preferably a helmet, which may be worn or displayed and which incorporates a secondary element appearing to effect the overall integrity of the helmet. For example, it would be desirable to incorporate a secondary element with a helmet where the secondary element is either extending from the torn article, morphing from within the article, splashing through a "liquefied" article, extending from a cracked article, or extending through an article having undergone a phase change, such as by melting. Preferably, these secondary elements would be associated with a particular sporting team.

SUMMARY OF THE INVENTION

In one preferred embodiment, the present invention provides for headgear comprising a generally domed-shaped crown having an exterior surface and a decorative secondary element extending from the exterior surface at an intersection area between the crown and the secondary element. A portion of the exterior surface of the crown may be raised above the intersection area to evince an association between the secondary element and the manner in which it extends from the crown.

The secondary element and the crown may be integrally molded to one another.

The secondary element may be indicia suggesting or identifying one of a particular sporting club, a business name and a corporate logo.

The secondary element may be indicia identifying one of a mascot and a team name.

The secondary element may be only partially formed.

The headgear may further comprise a facemask connected to the crown.

The raised portion of the exterior surface of the crown may give the appearance of the secondary element tearing through the crown.

The raised portion of the exterior surface of the crown may give the appearance of the secondary element morphing out of the crown.

The raised portion of the exterior surface of the crown may give the appearance of the secondary element splashing through the crown in a liquefied state.

The raised portion of the exterior surface of the crown may give the appearance of the secondary element cracking the crown.

The raised portion of the exterior surface of the crown may give the appearance of the secondary element altering the phase of the crown. The phase altering may be melting.

The intersection area may be non-linear. The intersection area may be non-geometric.

The raised portion of the exterior surface of the crown may be jagged.

The headgear may further comprise crown particles in the raised portion, the crown particles having the appearance of having been separated from the crown. The appearance of separation may be by cracking.

The raised portion of the exterior surface of the crown may completely circumscribe the intersection area.

The secondary element may be non-elastomeric.

The crown may further include an interior surface with the headgear further comprising padding attached to the interior surface.

The crown and the secondary element may be monolithic.

The secondary element may be horns to identify or suggest the Los Angeles Rams of the National Football League.

The secondary element may be a block of cheese to identify or suggest the Green Bay Packers of the National Football League.

The secondary element may be a dolphin fin to identify or suggest the Miami Dolphins of the National Football League.

The secondary element may be a rivet to identify or suggest the Pittsburgh Steelers of the National Football League.

The headgear may further comprise artwork adorning the crown, wherein the secondary element may be associated with the artwork.

In another embodiment, a helmet comprises a crown having a generally domed-shaped first portion and a second portion raised from the first portion. A secondary element may be attached to the first portion at an attachment area and the second portion may extend above the attachment area.

The crown and the secondary element may be integrally molded to one another.

The secondary element may be indicative of a sporting club.

The secondary element may be non-elastomeric.

The crown and the secondary element may be monolithic.

In yet another embodiment, a helmet may comprise a crown having a generally domed-shaped first portion and a second portion raised from the first portion. A secondary element may be attached to the second portion at an attachment area and the second portion may extend above the attachment area.

The crown and the secondary element are integrally molded to one another.

The secondary element may be indicative of a sporting club.

The secondary element may be non-elastomeric.

The crown and the secondary element may be monolithic.

In a further embodiment, a helmet may comprise a generally domed-shaped crown having an exterior surface, a facemask attached to the crown, and a secondary element extending from the exterior surface of the crown. The secondary element and the crown may be integrally molded to one another.

The crown and the secondary element may be monolithic.

The secondary element may be non-elastomeric.

The secondary element and the crown may be molded to give the appearance of the crown tearing from pressure applied by the secondary element.

The secondary element and the crown may be molded to give the appearance of the secondary element morphing from the crown.

The secondary element and the crown may be molded to give the appearance of the secondary element splashing through the crown in a liquefied state.

The secondary element and the crown may be molded to give the appearance of the secondary element cracking the crown.

The secondary element and the crown may be molded to give the appearance of the crown having undergone a phase alteration.

In another embodiment, a helmet may comprise a generally domed-shaped crown having an exterior surface, a facemask attached to the crown, and a secondary element extending from the exterior surface of the crown. The secondary element and the crown may be integrally molded to one another and the secondary element may appear to have morphed from the crown.

In still a further embodiment, an article for promoting a sporting club may comprise a base having a concave underside surface and a skirt at least partially circumscribing the underside surface. The article may be adapted to be attached to the convex crown of a helmet such that the skirt extends above the attachment point of the concave underside surface with the convex crown.

The skirt may be adapted to give the appearance of the article tearing through the helmet when attached thereto.

The skirt may be adapted to give the appearance of the article morphing from the helmet when attached thereto.

The skirt may be adapted to give the appearance of the article splashing through the helmet when attached thereto.

The skirt may be adapted to give the appearance of the helmet being cracked when attached thereto.

The skirt may be adapted to give the appearance of the helmet having undergone a phase alteration when attached thereto.

The skirt may be non-geometric.

BRIEF DESCRIPTION OF THE DRAWINGS

The subject matter regarded as the invention is particularly pointed out and distinctly claimed in the concluding portion of the specification. The invention, however, both as to organization and method of operation, together with features, objects, and advantages thereof will be or become apparent to one with skill in the art upon reference to the following detailed description when read with the accompanying drawings. It is intended that any additional organizations, methods of operation, features, objects or advantages ascertained by one skilled in the art be included within this description, be within the scope of the present invention, and be protected by the accompanying claims.

In regard to the drawings.

DETAILED DESCRIPTION

Figure 1:
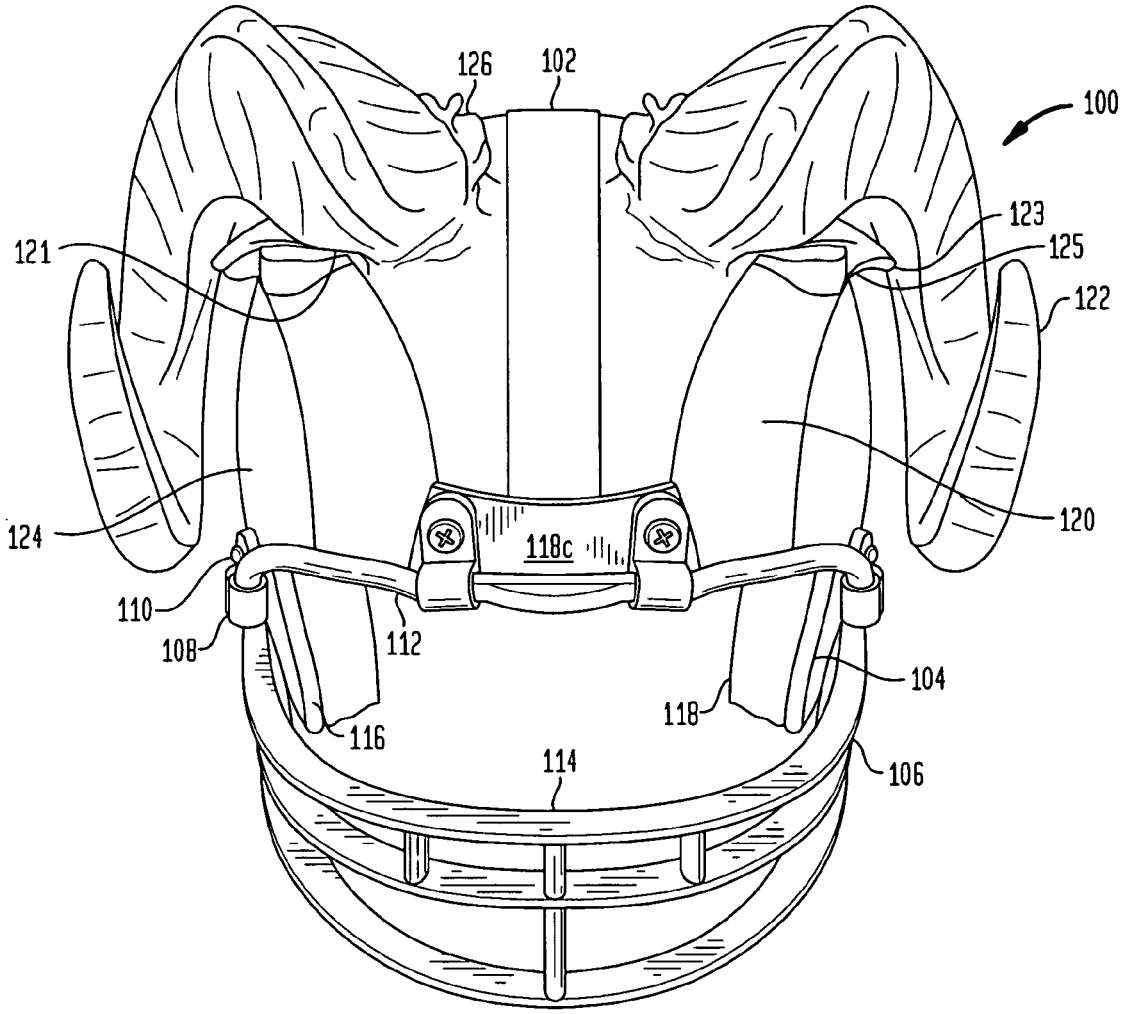
FIG. 1 is a frontal view of a helmet in accordance with a first embodiment of the present invention.

In the following is described the preferred embodiments of my article with three-dimensional secondary element. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose.

My invention is generally directed to articles having three-dimensional secondary elements. Preferred articles include helmets and hats. For ease of description, the concluding portions of this specification will generally discuss my invention in regard to the most preferred embodiment, that of a football helmet. It will be appreciated, however, that various other types of helmets, including sporting helmets such as hockey, baseball batting helmets, skiing, skateboarding, in-line skating, roller skating, motor sport helmets, climbing helmets, and the like may be utilized. Various non-sport related helmets may also be included. These include fireman's helmets, diving helmets, helmets for individuals with certain medical conditions, and the like. Other embodiments of the present invention may be directed to articles which are neither helmets or hats. Such embodiments include furniture such a headboards or chairs, office supplies such a staplers or tape dispensers, or other articles of manufacture.

Although sharing ties with each other, my invention can be broken down into general categories, which I refer to as tearing, morphing, splashing, cracking, and phase altering. The categories include similar characteristics that may not always be discussed with regard to each embodiment. Rather, the differences between embodiments will generally be detailed below.

Generally, the tearing category refers to helmets in which a secondary element is extending either from within the helmet or into the helmet and where the helmet appears to be torn by the secondary element. A torn helmet is typically one that is molded to included jagged edges which may also be bent slightly either into the helmet in the instance where the secondary element extends into the helmet, or out of the helmet in the instance where the object extends from within the helmet. Examples of a helmet having undergone a tearing effect are shown in FIGS. 1-5.

Figure 6:
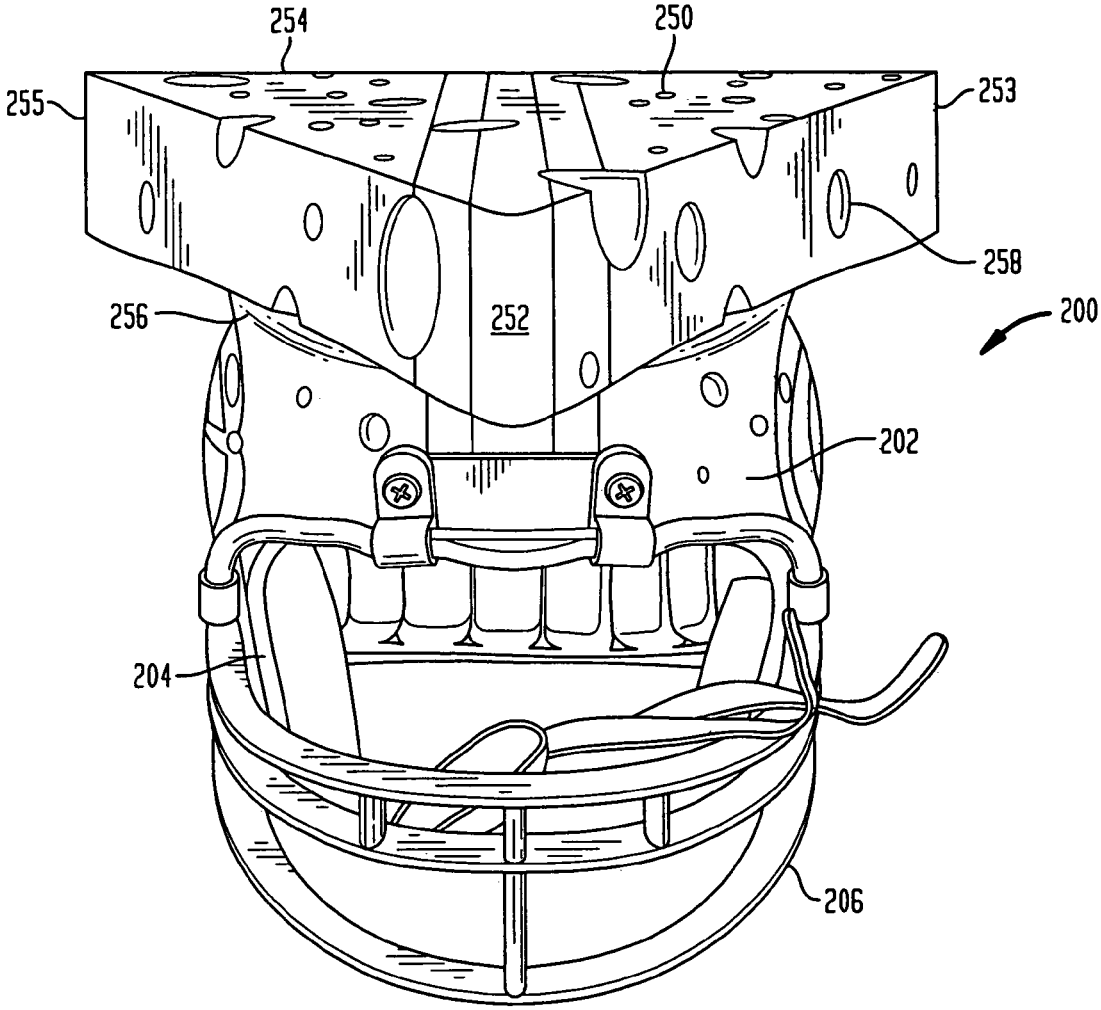
FIG. 6 is a frontal view of a helmet in accordance with a second embodiment of the present invention.
Figure 7:
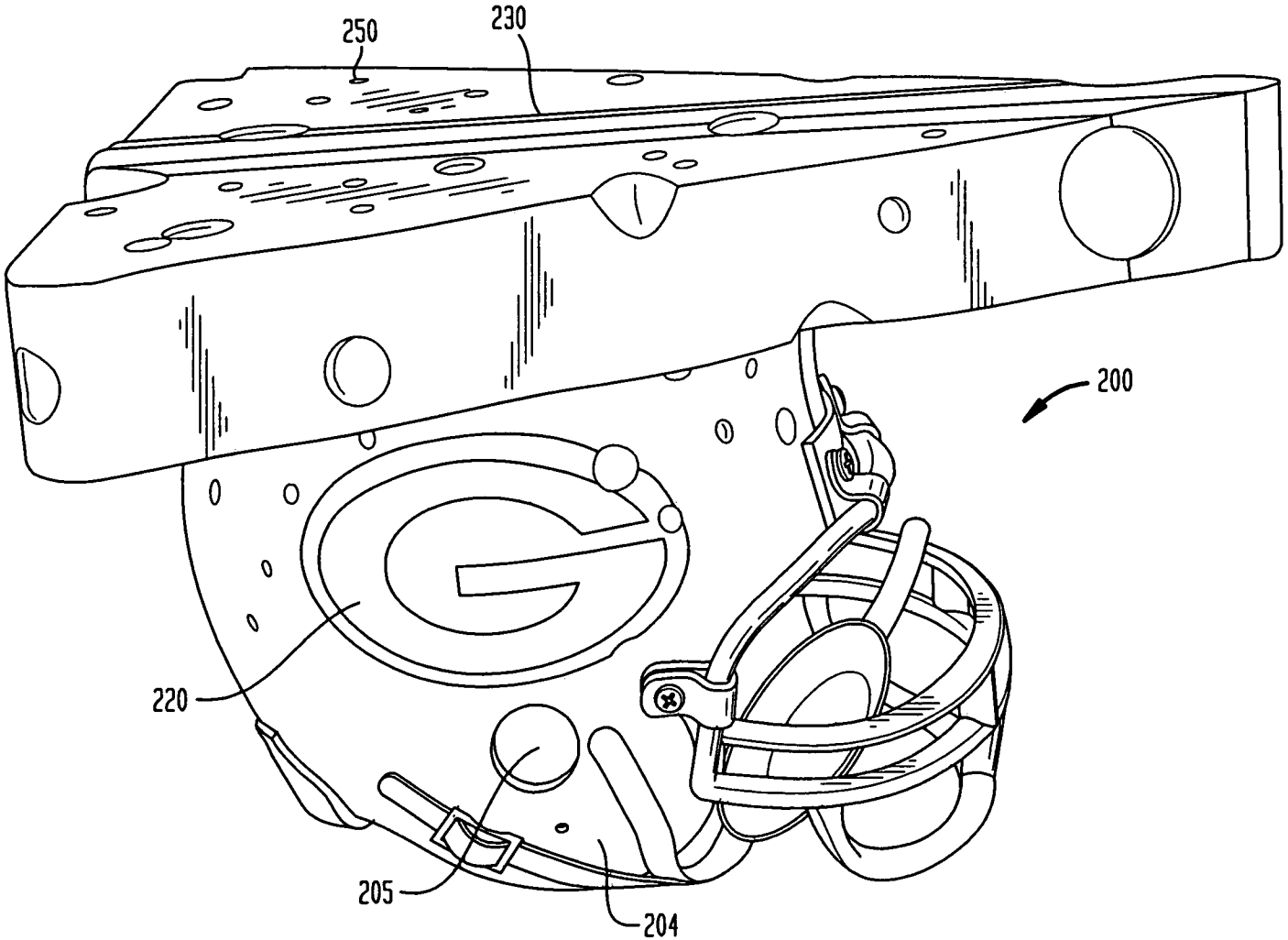
FIG. 7 is a side view of the helmet of FIG. 6.
Figure 8:
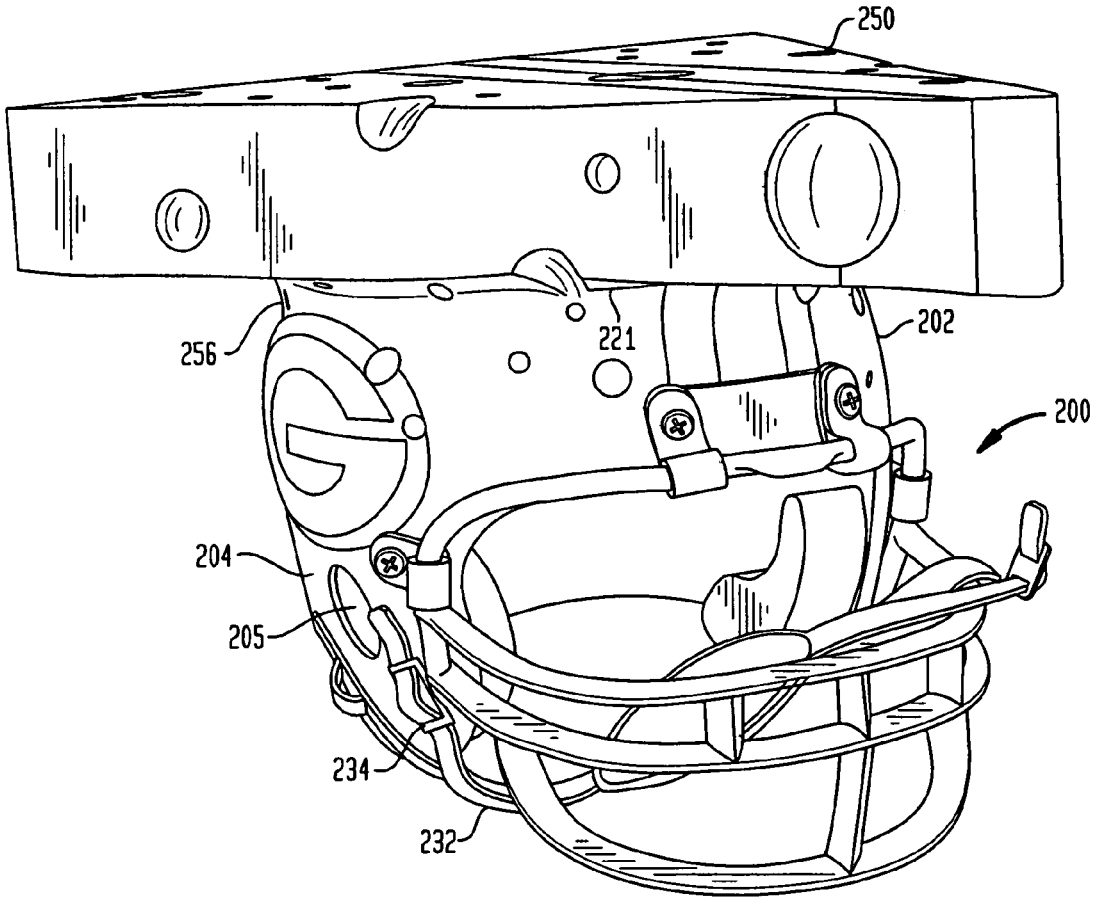
FIG. 8 is a perspective view of the helmet of FIG. 6.

A morphed helmet is one in which a secondary element appears to be formed or otherwise molded from the helmet itself. The transition from the helmet itself into the secondary element is typically smooth and continuous. Colorings, such as images or emblems, may also morph such that they smoothly transition from the helmet to the extending object. Although the helmet crown itself may morph to some degree, it is preferred that the general appearance and functionality of the helmet be retained. Examples of a helmet having undergone a morphing effect are shown in FIGS. 6-8.

Figure 9:
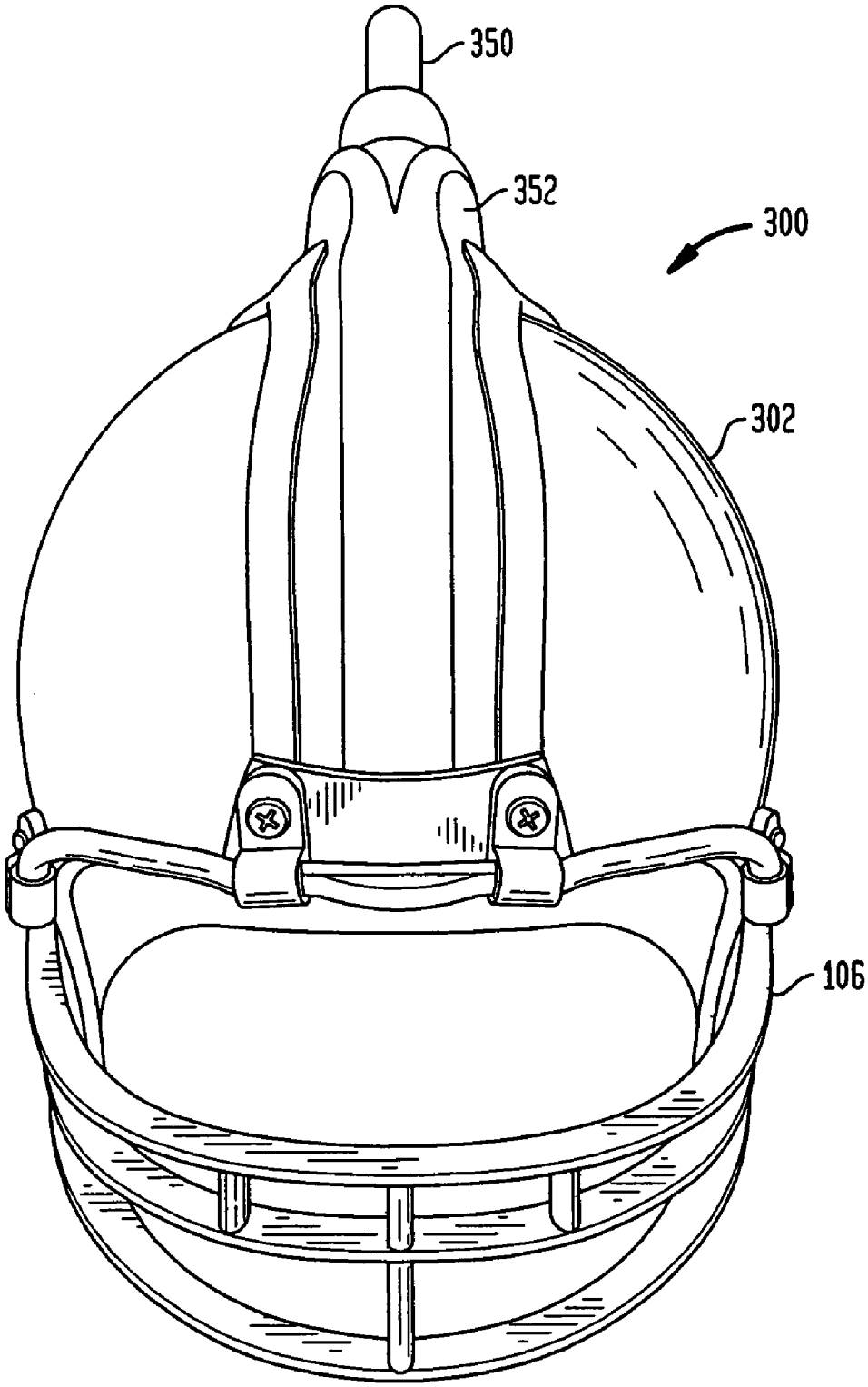
FIG. 9 is a frontal view of a helmet in accordance with a third embodiment of the present invention.
Figure 10:
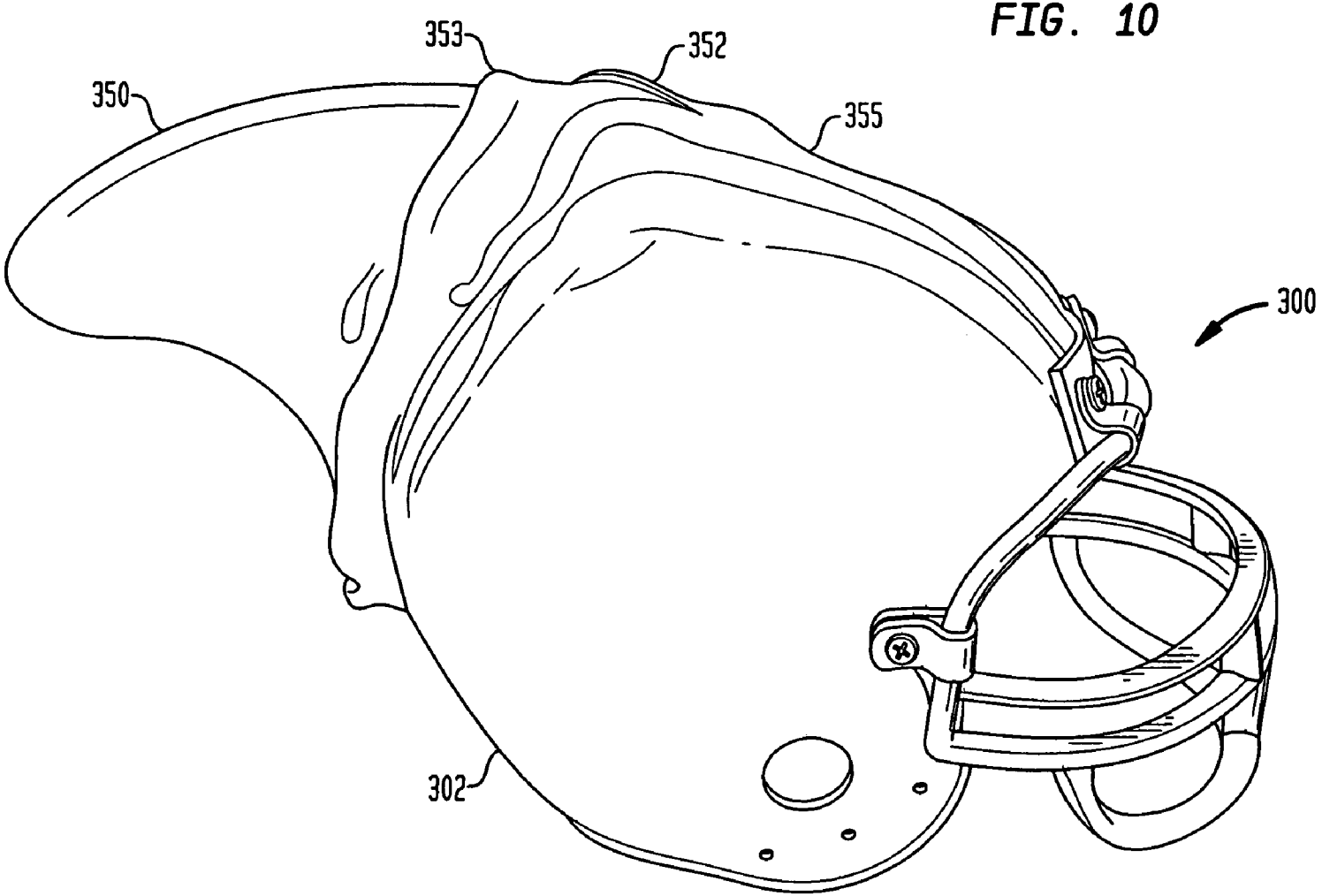
FIG. 10 is a side view of the helmet of FIG. 9.

The splashed helmet gives the impression of a secondary element splashing through a helmet, such as would occur if the helmet were liquified. The splashing may either be into the helmet, so as to form a splash or ripple of the type formed when a diver dives into a pool, or from the helmet so as to form a wave or a wake of the type a boat forms as it sails across water. Examples of a helmet having undergone the splashing effect are shown in FIGS. 9-10.

A helmet which gives the impression of being cracked is similar to that previously described as being torn. However, in a cracked helmet, the helmet itself generally does not bend or otherwise distort a great enough degree to give the impression of having been torn. Rather, a cracked helmet retains the general shape of an undisturbed helmet, but includes cracked edges, which may bend slightly, as the secondary object penetrates through. Particles broken from the cracked helmet may also appear, such as in the examples shown in FIGS. 11 and 12.

A helmet which gives the impression of having undergone a phase altering effect is one that has had the material comprising the helmet altered from its conventional phase, such as from a solid to a liquid by melting. Portions of the helmet may appear as a free flowing liquid, such as shown in the examples presented in FIGS. 14 and 15, where a secondary object which has been heated is shown to be piercing a helmet with localized melted areas.

I have found it most advantageous to create my novel helmet through the use of a retrofitting process incorporating manufactured helmets readily available in the marketplace. Of course, it may also be possible to form the helmet of my invention directly, without retrofitting a conventional helmet. Such direct formation is likely preferred for a mass produced set of helmets meeting the specifications herein detailed.

The method I utilize for constructing the inventive helmet is described below. In no means is this method intended to be the only method possible. In addition, each of the steps I performed was performed in the order indicated. Nevertheless, the steps may be performed in different orders, with equally successful results. The present listing is in no means intended to be exclusive of other orders of operation, or additional or fewer steps.

I first obtain a sport helmet of the type readily available in the marketplace. I then remove all of the hardware and padding, including the facemask, padding and chinstrap assemblies. I also remove all adhesive logos, such as the vinyl logos typically applied to helmets of this type. I then mount the helmet on a temporary base.

In order to mount the helmet on a temporary base I drill a ¼" diameter hole in the uppermost portion of the crown of the helmet. I also drill ⅛" diameter holes on the front left and front right sides of the helmet approximately ¾" down from the middle and 2" back from the front edge, in the vicinity of the conventional ear hole. Utilizing a 4"×4"×6" wooden block securing a ¼" diameter threaded rod approximately 1½' in length extending outwardly from the block, I create a mount for the helmet. I secure the helmet onto the threaded rod by first installing a nut on the rod, then placing the helmet over the rod through the ¼" diameter hole drilled in the top of the helmet crown, and then securing the helmet with a second nut placed over the top of the crown. Washers may also be used between the helmet and the nuts.

While the initial steps may be utilized for any helmet, the following steps will be described with relation to a helmet formed with three-dimensional ram horns tearing through the crown, such as might be produced for fans of the St. Louis Rams of the National Football League or the Colorado State Rams of National Collegiate Athletic Association. A helmet of the type produced by this procedure is shown in FIGS. 1-5.

Once secured on the wooden base, I then coat the outside of the helmet with a thin layer of petroleum jelly. I then place ⅛" diameter aluminum armature wire through each of the ⅛" diameter holes previously drilled on the left and right sides of the helmet. The ends of the armature wire are then anchored on the inside of the helmet by bending the wire into the helmet, against the inner surface. The remainder of the wire exterior to the crown of the helmet is formed into the configuration of ram horns. Each of the armature wires is then built up with layers of a two-part epoxy putty shaped to form ram horns. At the point of intersection between the helmet and the newly formed horns, the epoxy putty is molded and feathered into a skirt to create the illusion that the horns are tearing through the helmet. Additional epoxy is then added to the skirt at the intersection of the helmet and the horn to represent the torn portion of the helmet now folded over to give the appearance of having been torn away by the sudden growth of the ram horn. Once all of the epoxy dries, fine details are added using files and rotary tools.

At this point in the process the horned helmet is then ready to be molded. In order to form the mold, I clean off the horned sculpture with brushes and air supplied from an air gun. I also use a clean, dry cloth with rubbing alcohol to clean off any remaining dust or debris. I then drill holes to accommodate a size 4×1" long sheet metal screw on the bottom outside curve of each horn. On each screw I place a 5/16" outside diameter by 3/16" inside diameter rubber vent to approximately 3" in length. I then apply a thin coat of petroleum jelly over the horn sculptures, the helmet, and the vent tubes.

The left side horn and the left side helmet are then covered with a rubber molding compound. I follow this by covering the right side horn and the right side of the helmet with a rubber molding compound, being careful not to permit the two sides to touch. By successively layering the rubber molding material, I build the material up to a thickness of approximately ¼" around each horn, the helmet, and the vent tubes. Once the molding compound is dry, I straighten out each armature from inside the helmet and remove the rubber mold and horns together as a single piece per side.

On the base of each horn (the portion previously touching the helmet), I apply a second tube using the same process previously described. This tube is intended to be used as a fill tube, and is slipped over the armature wire. Approximately ¾" from the fill tube I drill another hole to accommodate a size 4×1" long sheet metal screw. I then place a third tube, identical to the others, over this screw. I apply a thin coat of petroleum jelly around the base of the horn, the vent tubes, and the edge of the rubber mold around the base of the horn.

Finally, I apply a rubber molding compound to the base of the horn, the outer edge of the rubber mold, and around the tubes while keeping the openings clear. The horn mold is now ready to be cast.

In order to make the reinforcing cast, I first cut and soak approximately one hundred 1"×3" strips of burlap fabric in cold water for 15 minutes each. I then wring out each strip until they are slightly damp. I also apply a thin coat of petroleum jelly around the entire outside of the ram horn mold and tubes.

The burlap strips are then soaked in plaster of paris for a short time. I take the strips and apply them to the outside of the rubber molds in three separate casting sections—one on the left side of the horn mold, one on the right side of the horn mold, and one on the base. Between the application of sections I wait for the previous section to dry. I also apply petroleum jelly to ensure that the three sections do not stick to each other. At this point it is helpful to note that while building the casts around the tubes, I make sure that each of the holes remain open. I build this cast thickness to about 1½", and then repeat for the other molds.

In order to remove the sculpture from the mold, I use a screwdriver with a slotted head to pry away the casts, being careful not to apply enough pressure to break the mold. I then remove the rubber mold base by pulling it off of the casts. I utilize a razor knife to cut through the molding on the edge of the horn and then remove the sculptured horn. Each of these steps is then repeated for the other horn.

I then clean the inside of each rubber mold with soapy water and a sponge or cloth. The rubber molds are then rinsed off with clean water and air dried.

In order to cast the final plastic horn, I spray the inside of the rubber mold and the base of the mold, including the vent and fill tubes, with two thin coats of universal mold release. I assemble the rubber molds together with the plaster casts. Using a crank strap, I fasten the plaster cast together. I then prepare a 60 cc syringe for filling the molds.

I prepare the syringe by fastening a new fill tube to the syringe with electrical tape. I then remove the plunger from the syringe and spray a thin coat of universal mold release into the interior of the syringe and the plunger. I cover the outside of the fill tube with a thin coat of petroleum jelly. The syringe is then filled with an uncured rigid urethane casting compound. After inserting the fill tube of the syringe into the fill hole of the mold, I fill the mold until the urethane casting compound reaches the uppermost portion of the top vent tube. I then permit the casting compound to dry and remove the plaster cast and the rubber mold from the final plastic horn. I then repeat these steps for the second horn.

In order to mount the horns to the helmet, I obtain a second new helmet and remove all the hardware and padding. I do not remove the vinyl ram horn logo yet. Rather, I take a razor knife and cut along the outline of the vinyl horn logo to score, or otherwise cut a groove into, the helmet. Once the helmet is scored, I remove the vinyl ram logo.

The entire helmet may then be sanded on both its inside and outside surfaces using 400-600 grit wet sandpaper. While sanding, I am careful not to entirely sand away the scored outline of the logo. The helmet may then be cleaned with tap water, dried, and then cleaned with rubbing alcohol. Once completely cleaned and dried, the scored ram logo may be outlined with blue automotive tape which is typically 1/16" to 1/8" thick. This outlining is typically repeated five times in order to build up the thickness of the tape. It will be appreciated that the outlining is conducted on the outside of the logo such that the tape creates a wall surrounding the logo.

Metalset A-4 epoxy may then be used to fill the inside of the walled-in logo. A Popsicle stick may be utilized to level the epoxy to the height of the outlined tape. Once the initial layer is dried, the epoxy may be sanded, cleaned and recoated with additional epoxy until the logo is the correct thickness and smoothness. The tape outline may then be removed and the logo wet sanded. The helmet is now prepared for application of the ram horns.

Once the helmet is prepared, I take one horn and aligned it onto the helmet. I then draw a pencil outline onto the helmet around the base of the horn. Using 200-400 grit sandpaper, I sand the base of the horn. I then clean the helmet and the base of the horn with rubbing alcohol and apply Metalset A-4 to the base of the horn and within the pencil outline of the horn base previously traced on the helmet. I then align the ram horn onto the helmet and sand the base of the horn and the helmet to blend the two together. I add more Metalset A-4 and re-sand the base of the horn and the helmet until they completely blend as one. I then lightly wet sand the horn with 400 grit sandpaper. At this point, the raw helmeted horn is completed, and it is ready for painting.

In order to paint the helmeted horn, I clean the horns and the helmet inside and out with DuPont® 2319S Plastic-Prep. I then spray the helmet and horns with two coats of DuPont® 2322S Plastic Adhesion Promoter. I then apply two coats of DuPont® white paint.

Once each of those components dries, I spray the helmet with its finish color both inside and outside with 2-3 light coats of paint. The helmet color for this particular helmet for use by a St. Louis Rams fan is blue, although other colors may obviously be used for other teams, or for so-called "alternate" uniforms of the St. Louis Rams. Once the helmet itself is painted, I mask off the helmet and begin to paint the horns.

In order to paint the horns, I spray the horns with a series of various colors until I obtain the desired effect. I finish off the horns with a matt finish clear coat. I then apply a clear coat of gloss finish to the helmet itself. To complete the project, I reinstall the helmet hardware and padding, to achieve the finished result.

This procedure is understandably most appropriate for a limited production run of horned helmets. Other procedures, which are likely more appropriate for mass production, but which would be prohibitively expensive for a limited run, include casting the entire helmet in a multi part mold, preferably a two-part mold. This two-part mold could have half of the helmet with one horn in a first mold and the other half of the helmet with the other horn in a second mold. The two halves could be joined at the center-line of the helmet, connecting the right and left sides, and sonic welded to form a complete helmet. Once completed, the helmet may be painted. Alternatively, the entire mold may be produced in the anticipated finished color for the helmet, with only the horns, both three-dimensional and those on the helmet itself, being painted. Finally, the horns may be molded and simply adhered to the helmet with the skirt area "hiding" the intersection area of the horn and the helmet.

Referring now to the Figures, various embodiments of my novel invention are shown. FIG. 1 depicts a frontal view of helmet 100 in accordance with a first embodiment of the present invention. As shown in FIG. 1 the helmet 100 is a football helmet and generally comprises each of the elements of a conventional football helmet. In that regard, helmet 100 comprises a domed or generally bowl-shaped crown 102 with earpieces 104 extending therefrom.

The helmet 100 also comprises a face mask 106 connected to both the crown 102 and the earpieces 104 by a plurality of mounting straps 108. Each mounting strap 108 is generally formed of a strip of material, preferably plastic, which is wrapped around the face mask 106 and secured to the crown 102 or earpiece 104 by screws 110. It will be appreciated that the face mask 106 includes an upper portion 112 and a lower portion 114. The upper portion 112 generally consists of a single bar around which the mounting straps 108 may wrap. The lower portion 114 extends outwardly from the crown 102 and earpiece 104 and may consist of a series of bars forming a grid. One familiar with the game of football will readily note that a variety of face mask 106 styles may be utilized, each generally adapted to be suitable to the particular position of the player utilizing the particular facemask.

Mounted to the interior surface 116 of the crown 102 is padding 118. The crown 102 of the helmet 100 is also adorned with an insignia 120, which in this case comprises a pair of painted ran horns.

In addition to the conventional elements previously described, the helmet 100 of this embodiment also includes a pair of horns 122 tearing out from the exterior surface 124 of the crown 102. The crown 102 of the helmet 100 is shown to tear at an intersection area 121, or point where the horn 122 meets the crown, as if the horns grew from within the helmet through the interior surface 116 and the exterior surface 124. Portions of the crown 102 are thus shown to extend above the generally domed, or bowl-like crown. These raised, or torn portions 126, generally form a skirt and circumscribe the intersection area 121 between the horn 122 and the crown 102 consisting of peaks 123 and valleys 125 of material formerly forming the intact crown 102 such that the raised area is jagged. Preferably, the intersection area 121 and raised portions 126 are non-geometric, so as to promote a natural appearance of the horns 122 having sprouted from within the helmet 100.

Figure 2:
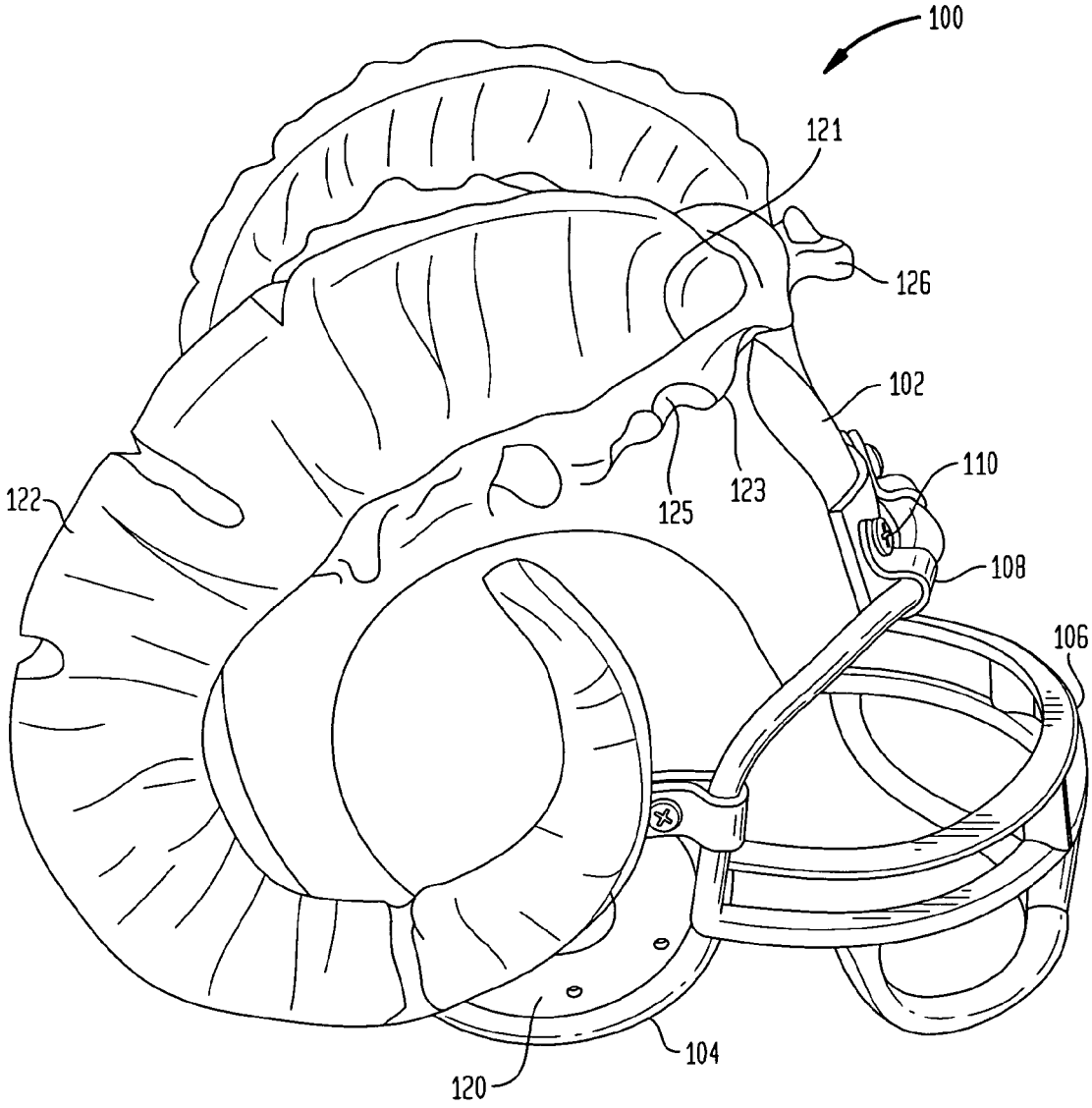
FIG. 2 is a side view of the helmet of FIG. 1.

FIG. 2 depicts a side view of the helmet 100 shown in FIG. 1. In this view, the torn portion 126 of the crown 102 is clearly shown as if having been peeled away to permit the horn 122 to extend therefrom. In this embodiment, the horn 122 first extends rearwardly, away from face mask 106 in a direction generally down toward earpiece 104 and then begins to curl forward toward the face mask, resembling the shape of the emblem 120 conventionally used by the St. Louis Rams.

Figure 3:
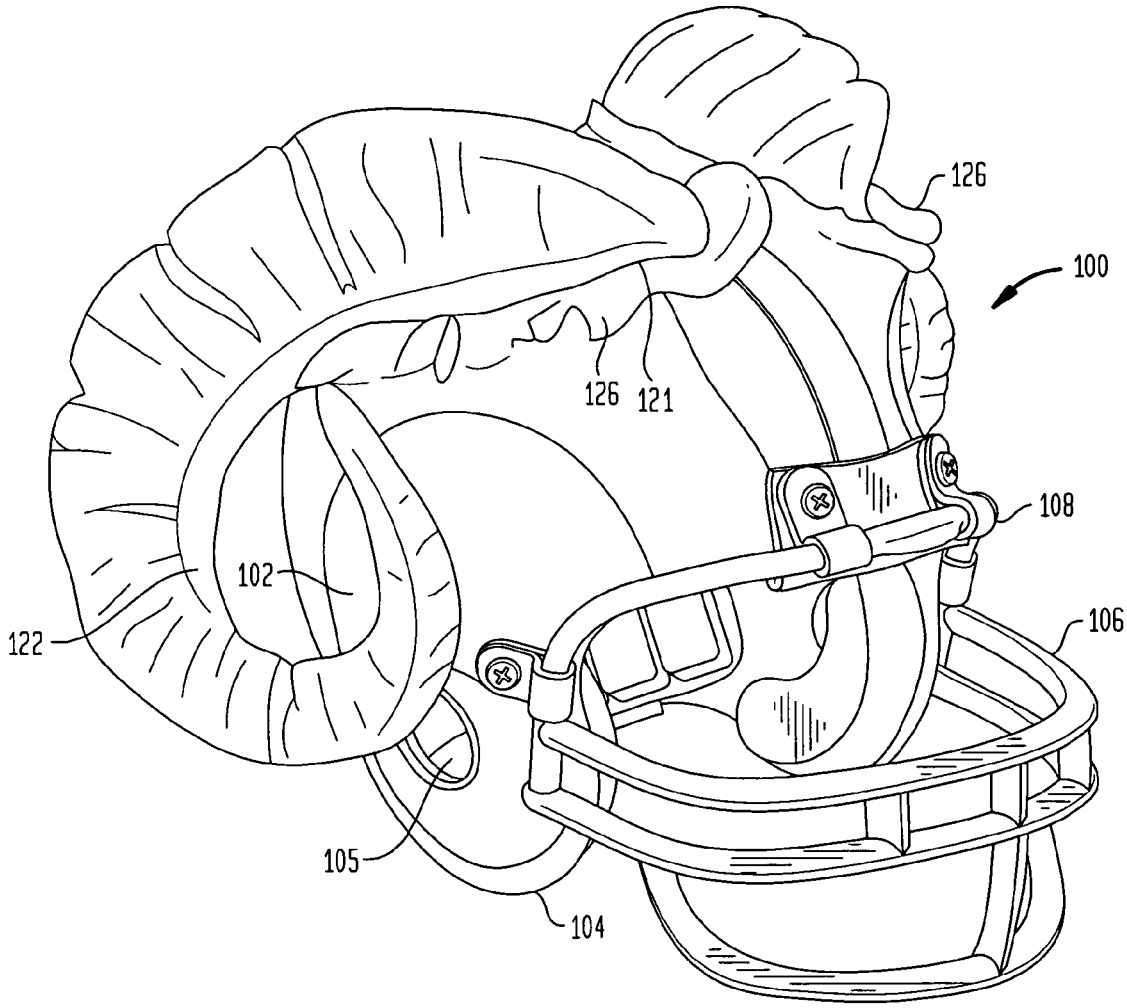
FIG. 3 is a perspective view of the helmet of FIG. 1.
Figure 4:
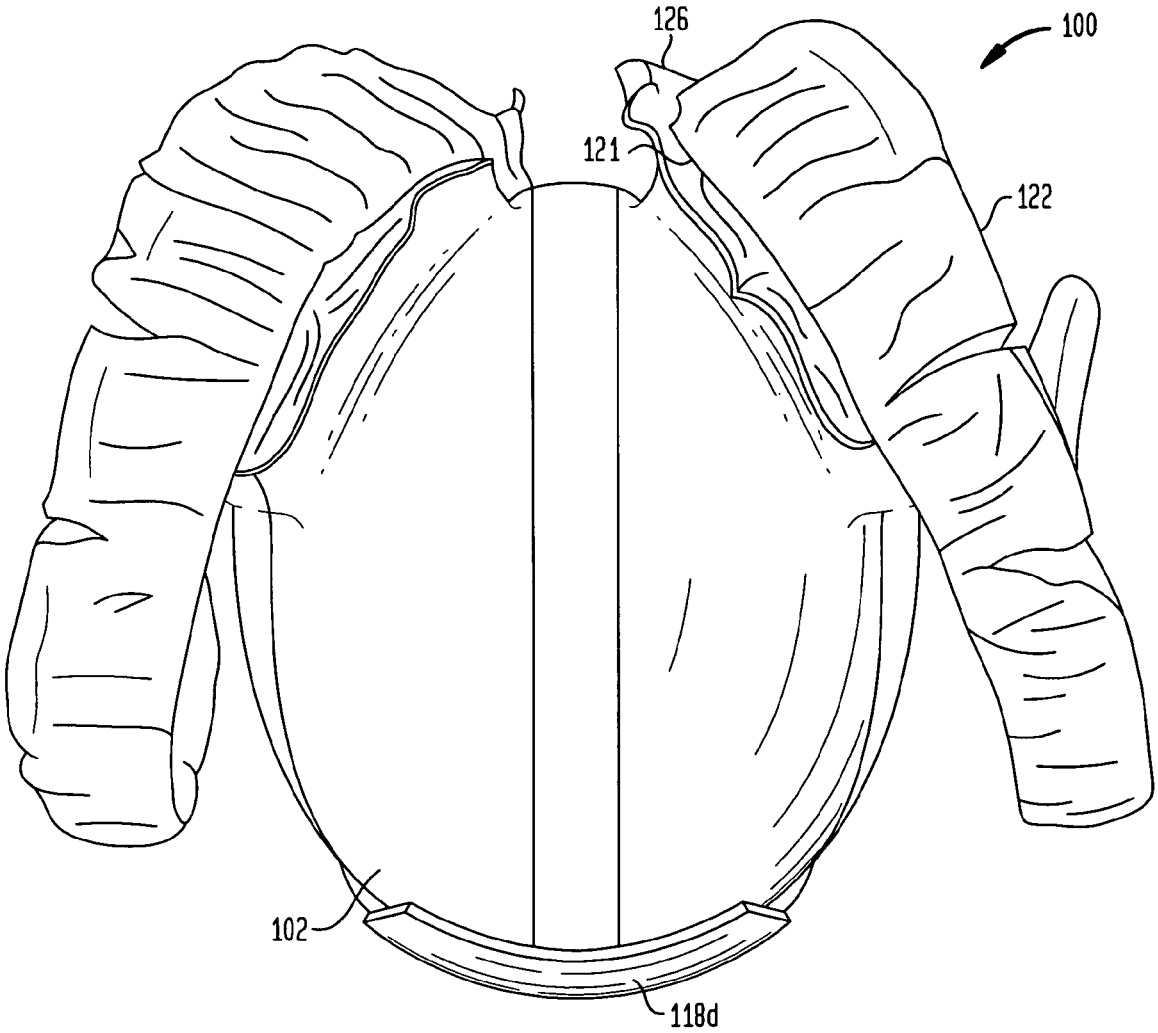
FIG. 4 is a rear view of the helmet of FIG. 1.

FIG. 3 depicts a perspective view of helmet 100 in accordance with the first embodiment of the present invention, while FIG. 4 depicts a rear view thereof. Each of these views shows how the torn portion 126 of helmet 100 circumscribes the horns 122, and how the intersection area 121 is adapted to smoothly transition from the crown 102 to the horns.

Figure 5:
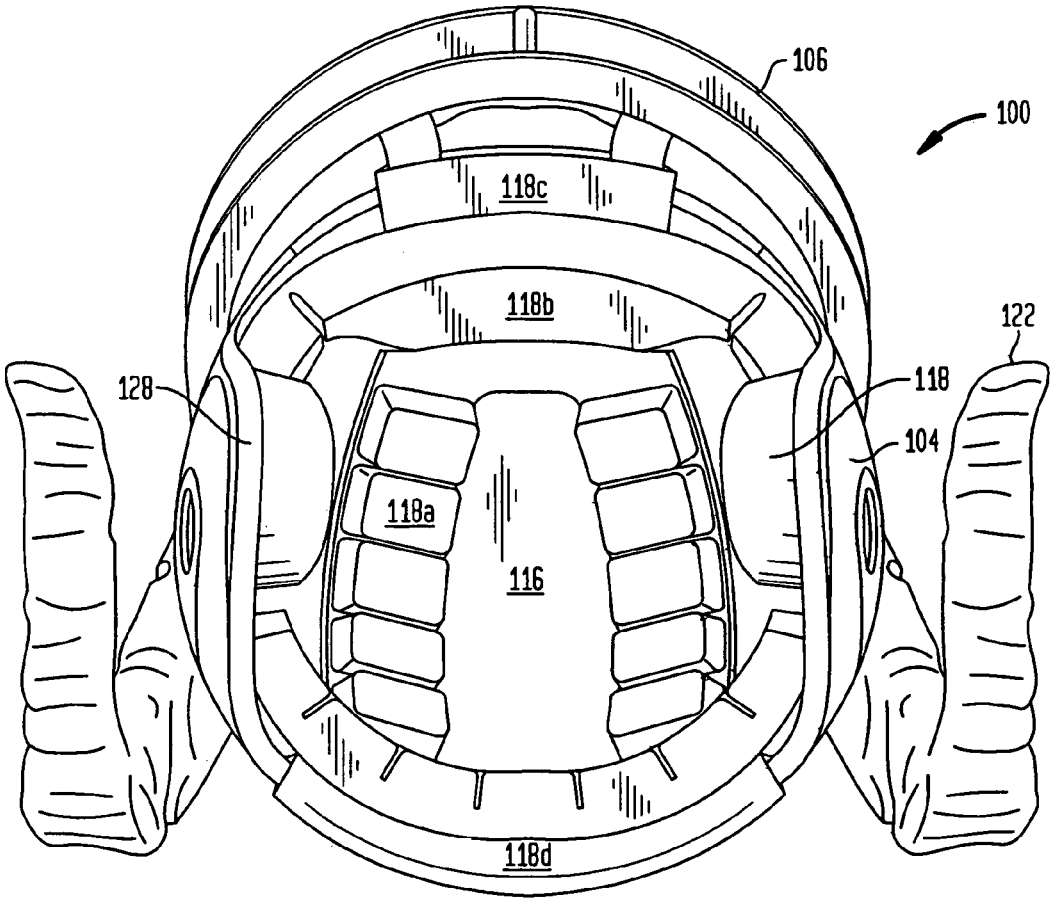
FIG. 5 is a bottom view of the helmet of FIG. 1.

As shown in FIG. 5, a bottom view of helmet 100, and as previously discussed, the interior surface 116 of helmet 100 may include padding 118. As conventionally used in football helmets, this padding 118 may comprise upper padding 118*a*, generally located in the crown 102 portion of the helmet, and lower padding 118*b* generally located below the upper padding and extending down into the earpiece 104 to protect the ears. Additional padded sections may wrap around the edge 128 of the crown 102 and earpiece 104. These additional padded sections include the forehead padding 118*c* and spine padding 118*d*.

It is preferable that no portion of the horns 122 extend through the interior surface 116 of the crown. This enables the helmet 100 to be worn, if so desired and if suitably sized. Preferably, helmets in accordance with this invention, such as helmet 100, are miniature sized and are not typically worn. Rather, they may be displayed or carried and exhibited to show an allegiance to a particular sporting team.

FIG. 6 depicts a frontal view of a helmet 200 in accordance with a second embodiment of the present invention. This embodiment is particularly suited for use by fans of the Green Bay Packers of the National Football League. Like the previous embodiment, this helmet 200 includes a crown 202, earpieces 204, and face mask 206. Rather than having horns as the previous embodiment, helmet 200 includes a fictitious block of cheese 250 mounted upon the crown 202, as if the cheese 250 morphed out of the crown 202. The cheese 250 is generally triangular with a leading point 252 facing toward the front of the helmet. Angled back toward the rear of the helmet are trailing points 253, 255. The top surface 254 of the cheese 250 is generally flat, while the bottom surface (not shown) is also generally flat and parallel to the top surface. At the area of intersection 221 of the crown 202 and the bottom surface (not shown) of the cheese 250, the crown 202 is blended into the cheese such that a chamfered portion 256 is created.

In addition to being triangular, the cheese may be adorned with various craters 258, such as those conventionally existing in a block of Swiss cheese. In addition, the crown portion 202 of the helmet 200 may include craters 258. The overall effect of the cheese 250 mounted upon the crown 202 is intended to be that of a block of cheese having morphed from the crown 202. As such, the transition area, or area of intersection 221, between the crown and the cheese 250 is preferably smooth and continuous, such as by chamfering.

FIG. 7 depicts a side view of the helmet 200. As with the previous embodiment, the helmet 200 may be adorned with an emblem 220 corresponding to the particular team in which the helmet represents. In addition to the emblem 220, certain embodiments, such as this one, may include painted stripes 230 along the center line of the helmet 200, from front to back. In this case, the stripe 230 also extends over the cheese 250 to further promote the appearance of the cheese having morphed from the helmet 200.

FIG. 8 depicts a perspective view of the helmet 200. In addition to those elements previously discussed as being included on a conventional helmet, the helmet 200 also includes a chin strap 232 that may mounted to each earpiece 204. Generally, the chin strap 232 is mounted by use of a male snap member (not shown) mounted on the earpiece 204 which may connect to a female snap member 234 forming a portion of the chin strap 232, as in a conventional helmet. As further shown in FIG. 8, the cheese 250 is integrally molded to the crown 202, forming a chamfered section 256 circumscribing the intersection area 221 of the crown and the cheese.

Also shown in FIG. 8 is an ear hole 205 provided through the earpiece 205. It will be appreciated that the ear hole 205 permits one wearing the helmet 200 to be capable of hearing sounds emanating from outside the helmet.

FIG. 9 depicts a frontal view of a helmet 300 in accordance with a third embodiment of the present invention. This embodiment is particularly suited for fans of the Miami Dolphins of the National Football League. In this embodiment, the crown 302 is molded such that a fin 350, such as that of a dolphin, appears to be splashing through the crown 302. In the areas directly adjacent the fin 350, the crown 302 is rippled to give the appearance of it being liquified. These liquified areas 352 blend seamlessly into the crown 302. The liquified area 352 completely circumscribes the fin 350 at the intersection of the fin and the crown 302.

FIG. 10 depicts a side view of the helmet 300 in accordance with the third embodiment of the present invention. As shown clearly in FIG. 10, the liquefied portion 352 includes peaks 353 and valleys 355, just as a real wave.

Figure 11:
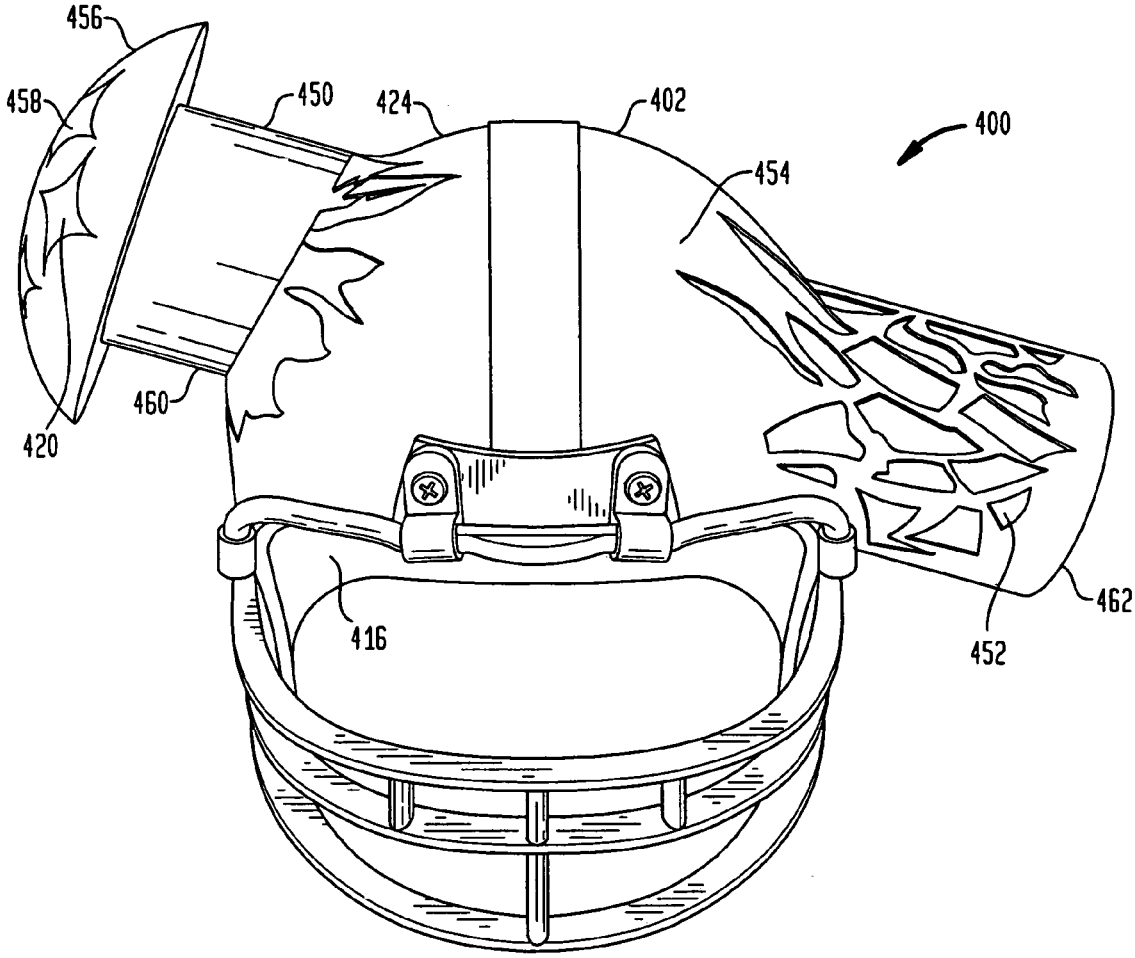
FIG. 11 is a frontal view of a helmet in accordance with a fourth embodiment of the present invention.

FIG. 11 depicts a helmet 400 in accordance with a fourth embodiment of the present invention. This particular helmet 400 is particularly suited for use by fans of the Pittsburgh Steelers of the National Football League.

In this embodiment, a rivet 450 appears to have been punched through the crown 402 of the helmet 400. To simulate this forceful penetration, the helmet 400 is shown to have cracked, including cracked particles 452 and splintered edges 454. The splintered edges 454 are formed from the crown 402 and curl out slightly at the point of intersection between the intact crown 402 and the rivet 450, such that the crown and the rivet blend seamlessly together. As with the other embodiments, the crown 402 and the secondary element protruding therefrom, in this case the rivet 450, are typically integrally molded.

The rivet 450 typically appears in the form of a conventional rivet. As such, it includes a mushroom shaped head 456 at its distal end 458 and a cylindrical shaft 460 extending from the mushroom shaped head 456 to the proximal end 462. As shown in FIG. 11, a portion of the cylindrical shaft 460 may penetrate through the crown 402 in two locations, such that it extends from an exterior surface 424 of the helmet 400 through the interior surface 416 and back out the exterior surface.

The mushroom shaped head 456 of the rivet 450 may include an emblem 420 associated with a particular sporting team, such as the Pittsburgh Steelers.

Figure 12:
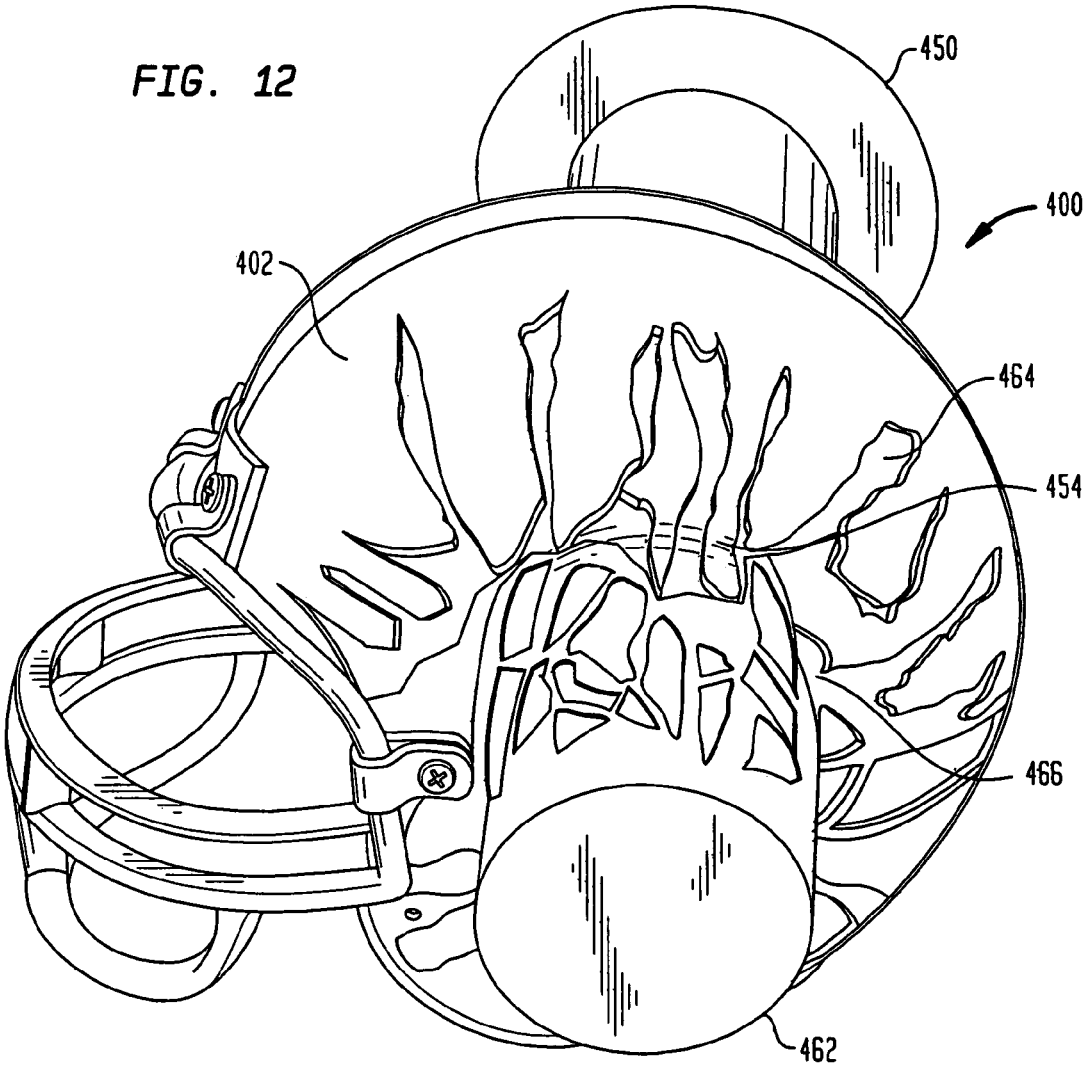
FIG. 12 is a side view of the helmet of FIG. 11.

FIG. 12 depicts a side view of the helmet 400. In this view, it is clearly shown that the splintered edges 454 may be spaced apart by open sections 464 to give the appearance of the proximal end 462 of the rivet 450 having been punched through the crown 402 so as to crack the crown. As previously stated, the splintered edges 454 may bend or otherwise deform in deformed areas 466 at the intersection of the crown 402 and the rivet 450. These deformed areas 466 help to give the appearance of the rivet 450 having penetrated the crown 402.

In addition, it should be clear that the cracked particles 452 may be broken completely away from the crown 402. Each is preferably integrally molded with the rivet 450.

Figure 13:
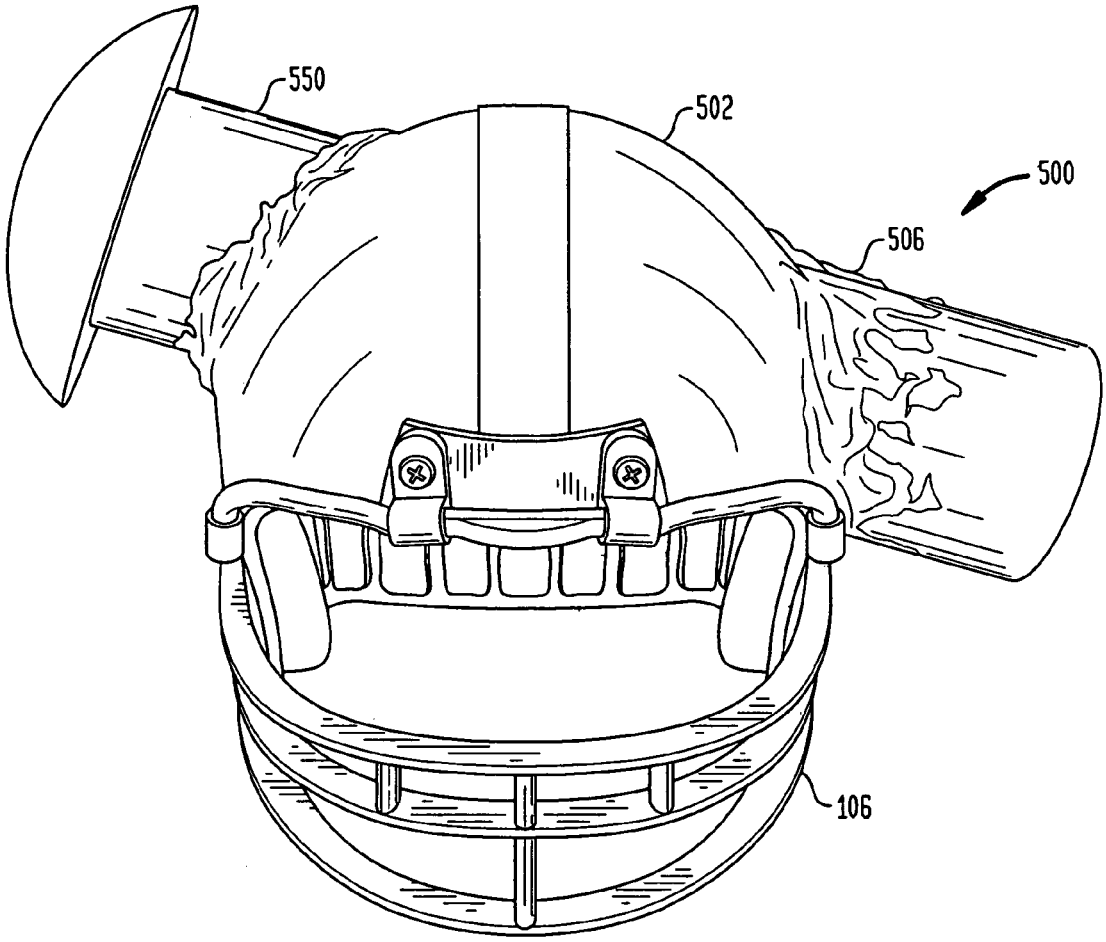
FIG. 13 is a frontal view of a helmet in accordance with a fifth embodiment of the present invention; and, FIG. 14 is a perspective view of the helmet of FIG. 13.
Figure 14:
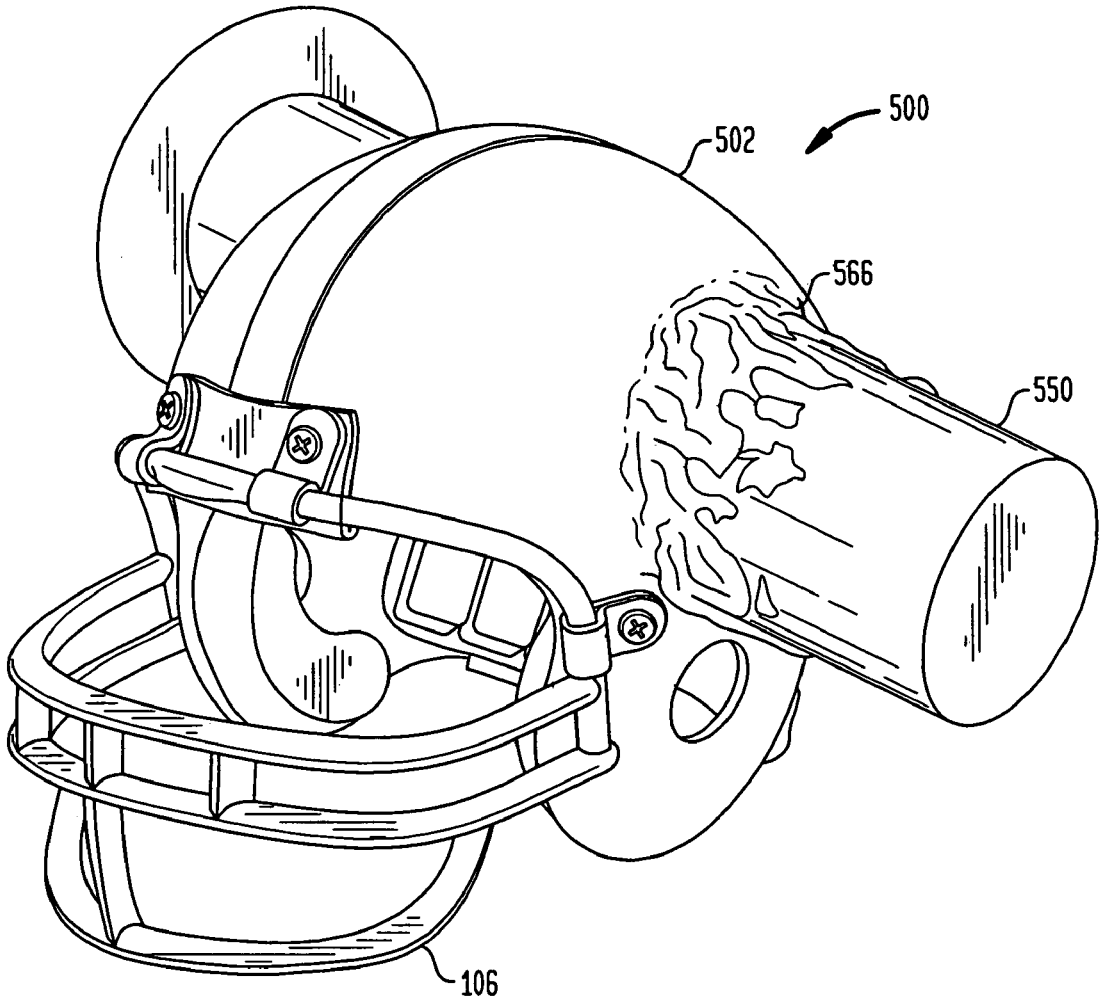

In a fifth embodiment of the present invention, such as shown in FIG. 13, a rivet 550 may give the appearance of having been heated beyond the melting point of the material comprising the crown 502 of the helmet 500 and then having been passed through the crown 502 by melting the crown. In this regard, the crown 502 may form melted areas 566 at the points where the rivet 550 intersects the crown 502. FIG. 14 depicts a perspective view of the helmet 500 in accordance with the fifth embodiment. In order to give the appearance of having been heated, the rivet 550 may be painted a bright color consisting of yellows and oranges.

The five embodiments depicted are intended to display only the preferred embodiments of the present invention. Generally, these embodiments include a secondary element either extending from a torn helmet, morphing from within a helmet, splashing through a "liquified" helmet, extending from a cracked helmet, or extending through a helmet having undergone a phase change, such as by melting. In addition to the embodiments shown, the following describes examples of helmet compositions that might be considered for use in the present invention for the various teams of the National Football League. In no event is this list to be considered as complete. Rather, it details exemplary embodiments of the inventor.

Chicago Bears: The helmet may have bear claws (painted in full color to be realistic) tearing out of the helmet from right to left. The claws may protrude out of the tears. The helmet may be molded with jagged edges to represent tearing of the helmet and logos.

Cincinnati Bangles: The helmet may have tiger claws (painted in full color to be realistic) tearing out of the helmet from back to the front, hitting and cracking the face mask. The helmet may be molded with jagged edges to represent tearing of the helmet and logos.

Buffalo Bills: The helmet may have buffalo horns (painted in full color to be realistic) tearing out of the left and right helmet logos. The helmet may be molded with jagged edges to represent tearing of the helmet and logos.

Denver Broncos: The helmet may have a mane of horse hair flowing from the front of the helmet to the back. The mane may be painted in team colors.

Tampa Bay Buccaneers: The helmet may have wooden planks molded out of plastic conforming to the shape of the helmet. The planks may be painted to look like an old wooden pirate ship. Alternatively, a skull may be molded to the back of the helmet. The skull may be shown wearing turban like head gear emblazoned team colors.

Arizona Cardinals: The helmet may include a cardinal's head bursting (as if breaking out of an egg) out of the right side logo. Bumps and dents may be included on the helmet to look like the bird was pecking at the inside of the helmet prior to his escape. The helmet paint may be chipped and cracked around the bumps and dents.

San Diego Chargers: Most of the helmet paint may be cracked. Large and small sections of the paint may be missing to expose storm clouds and lightning.

Kansas City Chiefs: The helmet may include an arrow hitting the back of a helmet split the helmet in two. The helmet may show tears along the path of the arrow. Alternatively, the helmet may include an arrowhead split in half each with each half being molded to, and mounted on, one side of the helmet. Mounted at the rear of each arrowhead may be a split arrow shaft molded to the contour of the helmet. The arrow shaft may become one at the back of the helmet. The helmet may be molded with jagged plastic to represent tearing of the helmet.

Indianapolis Colts: The helmet may include two horse shoes molded to look as if a horse had kicked back from the inside of the helmet. This gives the appearance that the force stretched the helmet, or morphed the helmet. There are no breaks or tears in the helmet. The paint around this stretched or morphed area may be cracked or missing.

Dallas Cowboys: The helmet may morph into a ten gallon hat molded and fastened to the top of the helmet. A three-dimensional old fashion sheriff's bade (star) may represent the Cowboy logo. Alternatively, the helmet may be molded to represent cowhide. The helmet may then be morphed to give the appearance that the cowhide was branded.

Miami Dolphins: As shown with respect to the third embodiment, a dolphin fin may be molded with the top of the helmet. The dolphin fin may be molded so as to give the appearance of the helmet having been "liquefied" such that the fin is moving through water. Further molding may give the appearance of water flowing around the fin. This area may be painted such that the paint fades gradually from the color of seawater to the helmet color.

Philadelphia Eagles: The helmet may include two wings tearing out of the front left and right helmet logo. The helmet may include jagged edges to represent tearing of the helmet and logos.

Atlanta Falcons: Two falcon claws may tear out of the left and right helmet logos pushing forward as if to catch their prey. The helmet may be molded with jagged edges to represent tearing of the helmet and logo.

New York Giants: The statue of liberty crown may tear out of the helmet. The helmet may be molded with jagged edges to represent tearing of the helmet and logo.

Jacksonville Jaguars: Claws may stretch or morph the helmet to give the appearance of trying to break the helmet from the inside. The claws may not tear through helmet. The paint may be cracked and chipped around the stretched portions.

New York Jets: The helmet may be ripped or torn to as if the helmet was going through a high speed forward motion. The peeled back team logo may reveal the skin of a jet plane. Alternatively, the helmet may be morphed to include a visor and oxygen mask to give the appearance of a cross between a sport helmet and a pilot's helmet.

Detroit Lions: The helmet may include a molded lion mane (front of the helmet) and lion tail (back of the helmet) morphed from the helmet. Alternatively, lion claws may be shown to tear out of the helmet. The helmet may be molded with jagged edges to represent tearing of the helmet and logo.

Tennessee Titans: The helmet may include a shield stretching or morphing from the side of the helmet. The shield may transition from the colors of the Titans' logo to a metallic color, such as silver. In addition, portions of the helmet may crack.

Green Bay Packers: As shown in the second embodiment, a wedge cut piece of cheese may be morphed from the top of the helmet. The helmet may include nicks and half cut circles to match the cheese wedge. Alternatively, wooden planks may be molded to the helmet to give the appearance of a crate with broker plank as if something is trying to break out.

Carolina Panthers: The helmet may include the head of a panther tearing out the right side logo. The helmet may be molded with jagged edges to represent tearing of the helmet and logo.

New England Patriots: The helmet may be molded to include a patriot hat morphed from the helmet. The logo on the helmet may be morphed to give the appearance of a patch a soldier might have worn.

Oakland Raiders: The helmet may include two swords tearing through the helmet. One sword may enter from the front left and extend to the back right while the other enters from the back left and exits the front right, such that the swords meet in the center tearing the helmet along their path. The helmet may be molded with jagged edges to represent tearing of the helmet and logo. Alternatively, a skull molded to the back of the helmet wearing turban may be morphed from the helmet.

St. Louis Rams: As in the first embodiment, two ram horns may tear out of the left and right side logos. The helmet may be molded with jagged edges to represent tearing of the helmet and logos.

Baltimore Ravens: A raven may tear out of the helmet right side logo. One claw of the Raven may be pushing down on the torn helmet and the raven's head may push up on the torn helmet trying to make its way out. The helmet may be molded with jagged edges to represent tearing of the helmet and logos.

Washington Redskins: The redskin logo may be molded in thee dimensions (like a coin). Full color and three-dimensional feathers may extend off the logo.

New Orleans Saints: The Saints logo made to look like stained glass, and may extend, or morph, from the helmet in three-dimensions.

Seattle Seahawks: The head of a hawk may stretch, or morph, the helmet in an attempt to "get out" from within the helmet. The paint may crack around this stretching.

Pittsburgh Steelers: As shown in the fourth embodiment, a rivet may be shown to give the appearance of having been punched through a helmet. The helmet may be cracked in the penetrated areas. Alternatively, as shown in the fifth embodiment, a molten metal rivet may be driven through a helmet, which is locally melted in the areas where the rivet contacts the helmet. The rivet may be painted to look red hot. A three-dimensional steel logo may be engraved in the head of the rivet.

Houston Texans: Steer horns may tear through the left and right side logos of the helmet.

Tennessee Titans: Swords may be shown to tear out of the helmet. The helmet may include jagged edges to represent such tearing.

Minnesota Vikings: Viking horns may tear through the left and right side logos of the helmet. The helmet may include jagged edges to represent such tearing. Alternatively, the helmet may include a Viking morphing from the helmet.

Although the invention herein has been described with reference to particular embodiments, it is to be understood that these embodiments are merely illustrative of the principles and applications of the present invention. It is therefore to be understood that numerous modifications may be made to the illustrated embodiments and that other arrangements may be devised without departing from the spirit and scope of the present invention as defined by the appended claims.

The invention claimed is:

1. Headgear comprising:

a generally domed-shaped crown having an exterior surface; and a decorative secondary element extending from said exterior surface at an intersection area between said crown and said secondary element;

wherein a portion of said exterior surface of said crown is raised above the intersection area to evince an association between the secondary element and the manner in which it extends from the crown;

wherein said secondary element and said crown are integrally molded to one another.

2. The headgear of claim 1, wherein said secondary element is indicia suggesting or identifying one of a particular sporting club, a business name and a corporate logo.

3. The headgear of claim 1, wherein said secondary element is indicia identifying one of a mascot and a team name.

4. The headgear of claim 1, wherein said secondary element is only partially formed.

5. Headgear comprising:

a generally domed-shaped crown having an exterior surface; and a decorative secondary element extending from said exterior surface at an intersection area between said crown and said secondary element;

wherein a portion of said exterior surface of said crown is raised above the intersection area to evince an association between the secondary element and the manner in which it extends from the crown;

further comprising a facemask connected to said crown.

6. The headgear of claim 1, wherein said raised portion of said exterior surface of said crown gives the appearance of said secondary element tearing through said crown.

7. The headgear of claim 1, wherein said raised portion of said exterior surface of said crown gives the appearance of said secondary element morphing out of said crown.

8. The headgear of claim 1, wherein said raised portion of said exterior surface of said crown gives the appearance of said secondary element splashing through said crown in a liquefied state.

9. The headgear of claim 1, wherein said raised portion of said exterior surface of said crown gives the appearance of said secondary element cracking said crown.

10. The headgear of claim 1, wherein said raised portion of said exterior surface of said crown gives the appearance of said secondary element altering the phase of said crown.

11. The headgear of claim 10, wherein said phase altering is melting.

12. Headgear comprising:

a generally domed-shaped crown having an exterior surface; and a decorative secondary element extending from said exterior surface at an intersection area between said crown and said secondary element;

wherein a portion of said exterior surface of said crown is raised above the intersection area to evince an association between the secondary element and the manner in which it extends from the crown;

wherein said intersection area is non-geometric.

13. Headgear comprising:

a generally domed-shaped crown having an exterior surface; and a decorative secondary element extending from said exterior surface at an intersection area between said crown and said secondary element;

wherein a portion of said exterior surface of said crown is raised above the intersection area to evince an association between the secondary element and the manner in which it extends from the crown;

wherein said raised portion of said exterior surface of said crown is jagged.

14. Headgear comprising:

a generally domed-shaped crown having an exterior surface; and a decorative secondary element extending from said exterior surface at an intersection area between said crown and said secondary element;

wherein a portion of said exterior surface of said crown is raised above the intersection area to evince an association between the secondary element and the manner in which it extends from the crown;

further comprising crown particles in said raised portion, said crown particles having the appearance of having been separated from said crown.

15. The headgear of claim 14, wherein the appearance of separation is by cracking.

16. The headgear of claim 1, wherein said raised portion of said exterior surface of said crown completely circumscribes said intersection area.

17. The headgear of claim 1, wherein said secondary element is non-elastomeric.

18. The headgear of claim 1, wherein said crown further includes an interior surface, said headgear further comprising padding attached to said interior surface.

19. Headgear comprising:

a generally domed-shaped crown having an exterior surface; and a decorative secondary element extending from said exterior surface at an intersection area between said crown and said secondary element;

wherein a portion of said exterior surface of said crown is raised above the intersection area to evince an association between the secondary element and the manner in which it extends from the crown;

wherein said crown and said secondary element are monolithic.

20. The headgear of claim 1, wherein said secondary element is horns to identify or suggest the Los Angeles Rams of the National Football League.

21. The headgear of claim 1, wherein said secondary element is a block of cheese to identify or suggest the Green Bay Packers of the National Football League.

22. The headgear of claim 1, wherein said secondary element is a dolphin fin to identify or suggest the Miami Dolphins of the National Football League.

23. The headgear of claim 1, wherein said secondary element is a rivet to identify or suggest the Pittsburgh Steelers of the National Football League.

24. The headgear of claim 1, further comprising artwork adorning said crown, wherein said secondary element is associated with said artwork.

25. A helmet comprising:

a crown having a generally domed-shaped first portion and a second portion raised from said first portion; and a secondary element attached to said first portion at an attachment area wherein said second portion extends above said attachment area.

26. The helmet of claim 25, wherein said crown and said secondary element are integrally molded to one another.

27. The helmet of claim 25, wherein said secondary element is indicative of a sporting club.

28. The helmet of claim 25, wherein said secondary element is non-elastomeric.

29. The helmet of claim 25, wherein said crown and said secondary element are monolithic.

30. A helmet comprising:

a crown having a generally domed-shaped first portion and a second portion raised from said first portion; and a secondary element attached to said second portion at an attachment area wherein said second portion extends above said attachment area.

31. The helmet of claim 30, wherein said crown and said secondary element are integrally molded to one another.

32. The helmet of claim 30, wherein said secondary element is indicative of a sporting club.

33. The helmet of claim 30, wherein said secondary element is non-elastomeric.

34. The helmet of claim 30, wherein said crown and said secondary element are monolithic.

* * * * *